US010602816B2

(12) United States Patent
Handwerker et al.

(10) Patent No.: US 10,602,816 B2
(45) **Date of Patent: *Mar. 31, 2020**

(54) UMBRELLAS WITH INFLATABLE PORTIONS

(71) Applicant: The Handwerker Umbrella Company LLC, New York, NY (US)

(72) Inventors: Neil Handwerker, New York, NY (US); Kevin Bailey, Ottawa (CA); James Henderson, Kanata (CA); Tim Haats, Ottawa (CA)

(73) Assignee: The Handwerker Umbrella Company LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/369,296

(22) Filed: Mar. 29, 2019

(65) Prior Publication Data

US 2019/0223566 A1 Jul. 25, 2019

Related U.S. Application Data

(63) Continuation of application No. 15/966,987, filed on Apr. 30, 2018, now Pat. No. 10,244,835, which is a (Continued)

(51) Int. Cl.
*A45B 9/02* (2006.01)
*A45B 25/16* (2006.01)
(Continued)

(52) U.S. Cl.
CPC ..... *A45B 19/02* (2013.01); *A45B 19/04* (2013.01); *A45B 25/14* (2013.01); *A45B 25/165* (2013.01); *A45B 25/143* (2013.01)

(58) Field of Classification Search
CPC ..... A45B 19/02; A45B 25/165; A45B 19/04; A45B 25/14; A45B 25/143
(Continued)

(56) References Cited

U.S. PATENT DOCUMENTS 269,317 A 12/1882 Peace
1,397,789 A 11/1921 Stonestreet
(Continued)

FOREIGN PATENT DOCUMENTS

CH 557157 A 12/1974
CN 85205356 U 11/1986
(Continued)

OTHER PUBLICATIONS

China Patent Office Action for CN App No. 201580072214.2, dated Aug. 28, 2018 (13 pages).
(Continued)

*Primary Examiner* — Robert Canfield
(74) *Attorney, Agent, or Firm* — Fish & Richardson P.C.

(57) ABSTRACT

Some umbrellas include a support assembly, canopy assembly, and a toroidal air bladder. The support assembly includes a pump and a handle. The canopy assembly includes a plurality of support ribs attached to the handle, and a sheet attached to each of the support ribs. The toroidal air bladder is coupled to the air pump, and the air bladder disposed about the handle and engages the support ribs.

5 Claims, 16 Drawing Sheets

Related U.S. Application Data continuation of application No. 15/523,625, filed as application No. PCT/US2015/058239 on Oct. 30, 2015, now Pat. No. 9,986,798.

(60) Provisional application No. 62/074,995, filed on Nov. 4, 2014.

(51) Int. Cl.
*A45B 19/02* (2006.01)
*A45B 19/04* (2006.01)
*A45B 25/14* (2006.01)

(58) Field of Classification Search
USPC ..... 135/20.2
See application file for complete search history.

(56) References Cited

U.S. PATENT DOCUMENTS

| | | | | |
|---|---|---|---|---|
| 1,411,560 | A | 4/1922 | Beaty | |
| 2,049,380 | A | 7/1936 | Huber | |
| 2,625,946 | A | 1/1953 | Kaston et al. | |
| 2,753,878 | A | 4/1953 | Halberstam | |
| 2,679,256 | A | 5/1954 | Bocchino | |
| 2,810,391 | A | 10/1957 | Jones, Jr. | |
| 2,827,066 | A | 3/1958 | Nussbaumer | |
| 3,361,145 | A | 1/1968 | Jones | |
| 3,538,928 | A | 11/1970 | Price et al. | |
| 3,683,947 | A | 8/1972 | Muller | |
| 3,802,451 | A | 4/1974 | Morris | |
| 3,863,661 | A | 2/1975 | Aburto | |
| 3,954,117 | A | 5/1976 | Wallace | |
| 4,068,675 | A | 1/1978 | Pappanikolaou | |
| 4,370,994 | A | 2/1983 | Pittman | |
| 4,643,210 | A | 2/1987 | Feld | |
| 4,747,422 | A | 5/1988 | Chung | |
| 4,870,983 | A | 10/1989 | Wang | |
| 5,040,555 | A | 8/1991 | Wang | |
| 5,253,602 | A | 10/1993 | Moriarty | |
| 5,421,354 | A | 6/1995 | Bolton | |
| 5,725,004 | A | 3/1998 | Moulder | |
| 5,894,855 | A | 4/1999 | Gefell | |
| 5,987,822 | A | 11/1999 | McNiff et al. | |
| 6,354,314 | B1 | 3/2002 | Iurincich | |
| 6,371,140 | B1 | 4/2002 | Atanda | |
| 6,913,030 | B1 | 7/2005 | Martinec | |
| 9,339,092 | B2 * | 5/2016 | Vaitl | A45B 19/02 |
| 2004/0099296 | A1 | 5/2004 | Chang | |
| 2006/0030881 | A1 | 2/2006 | Sharkey | |
| 2013/0152985 | A1 | 6/2013 | Vaitl | |
| 2013/0160804 | A1 | 6/2013 | Rose | |

FOREIGN PATENT DOCUMENTS

| | | | | |
|---|---|---|---|---|
| CN | 2071897 | U | 2/1991 | |
| CN | 2073682 | U | 3/1991 | |
| CN | 2790230 | Y | 6/2006 | |
| CN | 201675189 | U | 12/2010 | |
| EP | 0 335 747 | A2 | 10/1989 | |
| FR | 2252823 | A | 6/1975 | |
| FR | 2582489 | A1 | 12/1986 | |
| FR | 2654595 | A1 | 5/1991 | |
| FR | 2848391 | A1 * | 6/2004 | A45B 19/02 |
| GB | 2369993 | A * | 6/2002 | A45B 19/02 |
| JP | S5465256 | U | 5/1979 | |
| JP | 06133812 | A * | 5/1994 | |

OTHER PUBLICATIONS

European Search Report for App No. 15856862.6, dated Oct. 30, 2017 (7 pages).
International Search Report issued by ISA/US dated Jan. 21, 2016 for PCT/US2015/058239.
China Patent Office Action for CN App No. 201580072214.2, dated Jan. 20, 2020 (35 pages) (with English Translation).

* cited by examiner

UMBRELLAS WITH INFLATABLE PORTIONS

TECHNICAL FIELD

This disclosure relates to umbrellas, and more particularly to umbrellas with inflatable portions.

BACKGROUND

An umbrella is a device designed to protect a user against the elements (e.g., rain, snow, sleet, sunlight, and wind). Some umbrellas are hand-held device that, when deployed, shield one or more users with a portable protective canopy. Some umbrellas are fixed or semi-fixed devices that are deployed to provide protection to a particular area, such as an outdoor patio, walkway, beach, field, or other area. In general, umbrellas are resilient against the elements (e.g., having water, wind, and/or sun resistant properties) to provide its users with the desired degree of protection.

SUMMARY

Some umbrellas include a support assembly, canopy assembly, and a toroidal air bladder. The support assembly includes a pump and a handle. The canopy assembly includes a plurality of support ribs attached to the handle, and a sheet attached to each of the support ribs. The toroidal air bladder is coupled to the air pump, and the air bladder disposed about the handle and engages the support ribs.

Some umbrellas include a support assembly and a canopy assembly. The support assembly includes a pump and a handle. The canopy assembly includes a hub member attached to the handle, a plurality of air bladders attached to the hub member and coupled to the air pump, and a sheet attached to each of the air bladders.

Some embodiments of these umbrellas include one or more of the following features.

In some embodiments, the umbrella is configured to reversibly switch between a stowed configuration and a deployed configuration. In some cases, in the stowed configuration, the air bladder is deflated and the support ribs extend from the handle in a direction substantially parallel to the handle. In some cases, in the deployed configuration, the air bladder is inflated, the support ribs are supported by the air bladder at an angle with respect to the handle, and the sheet extends between adjacent support ribs.

In some embodiments, the pump is incorporated into the handle.

In some embodiments, the umbrella further includes a hub attached to an upper portion of the handle. In some cases, the hub attaches the plurality of support ribs to the handle. In some cases, the toroidal air bladder is attached to the hub. In some cases, plurality of support strips attach the toroidal air bladder to the hub.

In some embodiments, an umbrella further includes a stabilizer attached to the support ribs. The stabilizer limits the support ribs to a pre-defined angular range with respect to the handle.

In some embodiments, the support assembly further includes an air release mechanism operable to release air within the toroidal air bladder.

In some embodiments, the air release mechanism includes a collar disposed about an outer periphery of the support assembly. The collar is configured to reversibly switch between a first position and a second position. In the first position, the collar obstructs a channel in fluid communication with the toroidal air bladder, thereby preventing the air within the toroidal air bladder from flowing through the channel and escaping from the umbrella. In the second position, the collar does not obstruct the channel, thereby allowing the air within the toroidal air bladder to flow through the channel and escape from the umbrella.

In some embodiments, the umbrella is configured to reversibly switch between a stowed configuration and a deployed configuration. In some cases, in the stowed configuration, the air bladders are deflated. In some cases, in the deployed configuration, the air bladders are inflated and extend from the hub member at an angle with respect to the handle, and the sheet extends between adjacent air bladders.

In some embodiments, the pump is incorporated into the handle.

In some embodiments, the hub member includes a valve operable to control the release of air from the air bladders.

In some embodiments, the hub member includes a plurality of valves. Each valve associated with a corresponding air bladder and operable to control the release of air from the corresponding air bladder.

The details of one or more embodiments are set forth in the accompanying drawings and the description below. Other features and advantages will be apparent from the description and drawings, and from the claims.

DETAILED DESCRIPTION

Umbrellas can include inflatable components. For example, some umbrellas include one or more inflatable members that allow the umbrellas to switch between a stowed configuration (e.g., a collapsed configuration that is more suitable for transport) and a deployed configuration (e.g., an extended configuration that provides a user with protection). These inflatable members can include air bladders with inflated shapes such as, for example, toroids, straight beams, and curved beams. Umbrellas that include these inflatable members can be quickly stowed and deployed, allowing a user to conveniently transport and use the umbrella as needed. In some cases, umbrellas with inflatable members are also more resilient than umbrellas that only have rigid structural members, and are more resistant to wind or other potentially damaging external forces. Umbrellas with inflatable members can also allow a user to control the degree of rigidity of the umbrella enabling users to controllably strengthen the umbrella as appropriate for the desired applications or conditions.

Figure 1A:
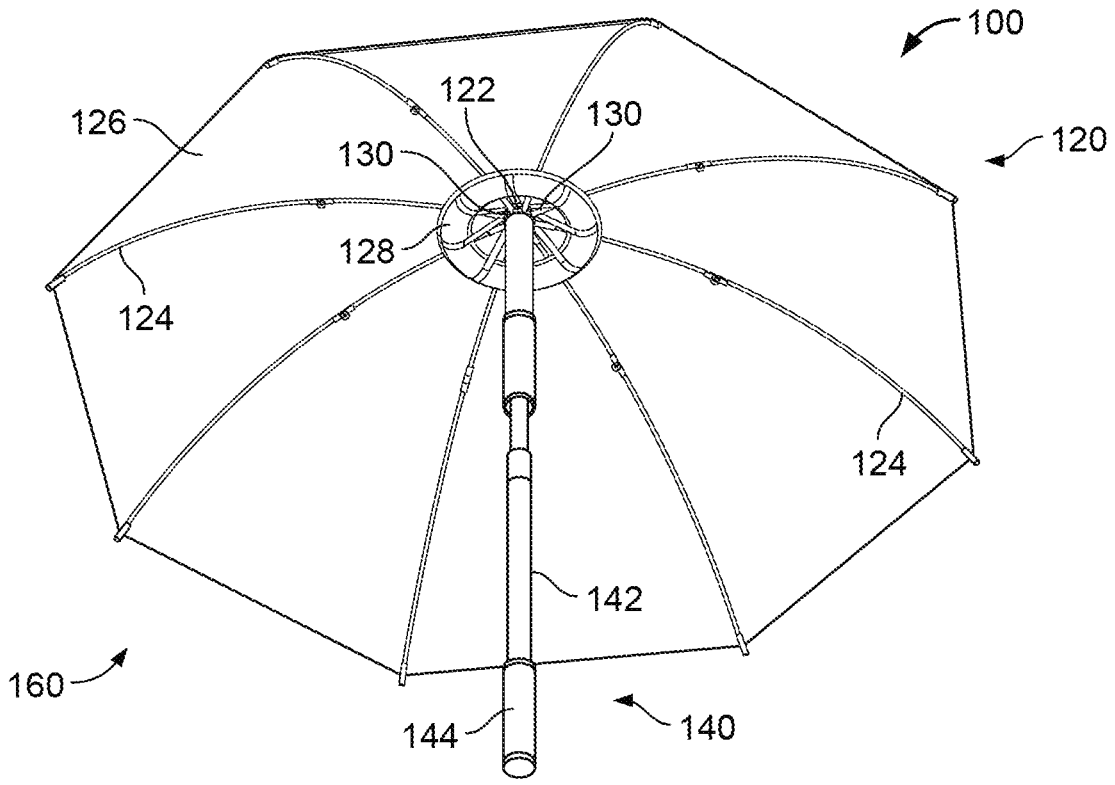
FIG. 1A and FIG. 1B are, respectively, a perspective view and a cross-sectional view of an umbrella shown in FIG. 1A
Figure 1B:
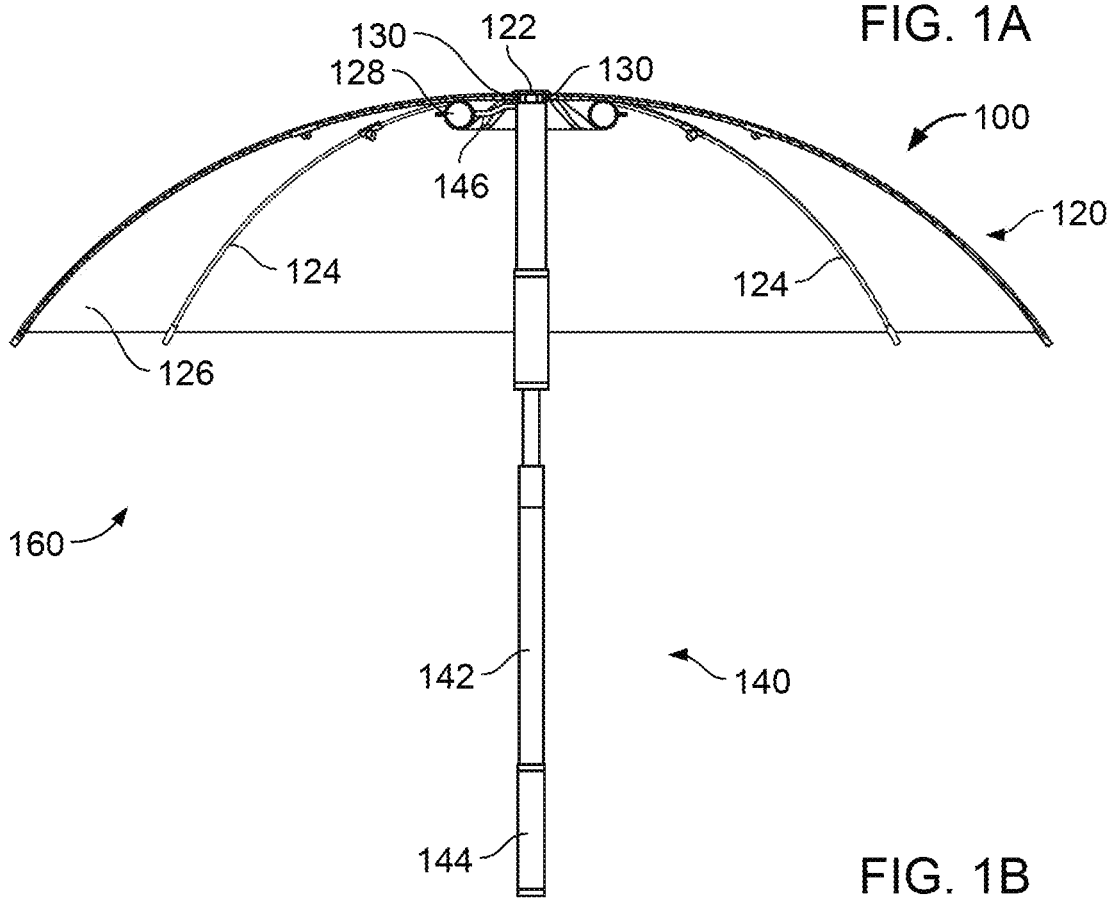

An example umbrella 100 is shown in FIG. 1A and FIG. 1B. The umbrella 100 includes a canopy assembly 120 and a support assembly 140. The canopy assembly 120 includes a hub 122, several support ribs 124, a sheet 126, an air bladder 128, and several joints 130. The support assembly 140 includes a pump 142, a handle 144, and a tube 146.

The hub 122 provides a central attachment point for components of the canopy assembly 120, and attaches the canopy assembly 120 and the support assembly 140 to each other. The hub 122 of umbrella 100 has a generally toroidal shape, and is fixed to an upper portion of the support assembly 140.

The support ribs 124 provide structural support for the canopy assembly. Each support rib 124 is a rod or strip that is attached on one end to the hub 122, and extends radially outward from the hub 122 at equidistant points about the outer periphery of the hub 122. Each support rib 124 is attached to the hub 122 through a corresponding articulated joint 130. The joint 130 allows the support rib 124 to pivot with respect to the hub 122 between a stowed position (e.g., such that the support rib 124 extends in a direction approximately parallel to an axis of the support assembly 140, or at a relatively small angle to the axis of the support assembly 140) and a deployed position (e.g., such that the support rib 124 extends at an angle to the axis of the support assembly 140, or at a larger angle to the axis of the support assembly 140 relative to that of the stowed position). The joints 130 can be or include a pivot, a hinge, a ball and socket, a saddle, or other articulating mechanism that allows the support ribs 124 to pivot between the stowed position and deployed positions. As shown in FIG. 1A and FIG. 1B, when the support ribs 124 are in a deployed position, each support ribs 124 bows downward, forming an arc or curve.

The sheet 126 protects a region 160 below the canopy assembly. The sheet 126 is attached each of the support ribs 124, and extends between adjacent support ribs 124. When the support ribs 124 are in a stowed position, the sheet 126 is loosely draped from each of the support ribs 124. When the support ribs 124 are extended to a deployed position, the sheet 126 extends with the support ribs 124, and is tightly drawn between the support ribs 124, protecting the region 160 below the canopy assembly, for example, from rain or sunlight. The sheet 126 is composed of one or more materials that are resistant to the elements such as, for example, a material that blocks rain (e.g., polyethylene terephthalate or stretchable nylon). In some implementations, the sheet 126 is opaque to block sunlight.

The air bladder 128 provides a mechanism for controllably pivoting the support ribs 124 between the stowed position and the deployed position and/or for supporting the support ribs in the deployed position. The air bladder 128 is generally toroidal in shape, and is positioned about the support assembly 120 along the underside of sheet 126. The air bladder 128 is substantially air tight, and can be fully or partially inflated such that its internal volume is filled with air pressurized or compressed relative to the ambient environment. The air bladder 128 can be deflated by releasing such compressed air. When deflated, the air bladder 128 does not have a substantially rigid form, and the support ribs 124 hang from the hub 122 in a direction substantially parallel to the support assembly 140 (or at a relatively small angle with respect to the support assembly 140). When partially inflated, the air bladder 128 increases in rigidity, and enlarges about the support assembly 140.

In umbrellas in which the air bladder 128 provides a mechanism for controllably pivoting the support ribs 124, the enlarging air bladder 128 contacts the support ribs 124, and pushes the support ribs 124 away from the support assembly 140 as the air bladder 128 inflates. This force causes the support ribs 124 to pivot at joints 130 with respect to the hub 122, extending the support ribs 124 at an increasingly large angle with respect to the support assembly 140. As the air bladder 128 continues to inflate, the support ribs 124 are pushed further and further outward, until the support ribs 124 are in a fully deployed position. Each support rib is supported on one end by the central hub and on the other end by the fixed length of fabric around a 360 degree circumference on the outer most diameter of the canopy. The canopy is sewn to locate the ribs in a symmetric pattern and limits their movement. When pressure is applied by the air bladder, it pushes on each rib part way between the two fixed ends of the rib and bends the rib into an arc creating a curved canopy structure and tightening the canopy. In the fully deployed position (e.g., as shown in FIG. 1A and FIG. 1B), the sheet is 126 is tightly drawn between the support ribs 124, forming a protective canopy. The sheet 126 is tightly drawn between the support ribs 124, forming a structural hold on the symmetric canopy to bias the canopy towards staying perpendicular to the central shaft of umbrella. The air bladder 128 can have varying degrees of rigidity of the umbrella shape, depending on the amount of air compressed within it.

In some cases, the range of motion of the support ribs 124 is limited, such that they cannot extend beyond the fully deployed position. For example, some umbrellas include joints 130 that limit the range of motion of the support ribs 124 (e.g., joints 130 with a limited range of articulation). As another example, some umbrellas include a stabilizer that is attached to the support ribs 124, which limits the range of motion of the support ribs 124. Stabilizers are discussed in greater detail below.

The air bladder 128 can have varying degrees of rigidity, depending on the amount of air compressed within it. As such, the rigidity of the umbrella 100 can be varied by driving more or less air into the air bladder 128. The air bladder 128 biases the support ribs towards the deployed position. Some umbrellas include another opening mechanism such as, for example, a spring and use the air bladder 128 for helping maintain the support ribs in the deployed position after the support ribs are positioned by the opening mechanism.

The size of the air bladder 128 and the air pressure contained within the air bladder 128 can vary based on one or more factors. For example, air bladders that differ in size and/or air pressure have different rigidities, and can also affect the curvature of the sheet 126. As such, the size of the air bladder (e.g., the inner and outer diameters of the air bladder) and/or the air pressure contained within it can vary depending on the desired physical characteristics of the umbrella 100. In some cases, for example to increase inflation and deflation speed, a small diameter and low air pressure is used. As an example, to support an umbrella approximately 40 inches in diameter, some air bladders have an outer diameter of approximately 8 inches (e.g., between 7 and 9 inches), and an air pressure between 5 and 15 psi when inflated. In practice, other sizes and air pressure are also possible.

The pump 142 is coupled to the air bladder and is operable to compress air from outside the umbrella 100 (e.g., from the ambient environment) into the air bladder 128. The pump 142 is coupled to the air bladder 128 through a tube 146, which provides an air-tight channel for air to travel between the pump 142 and the air bladder 128. In umbrella 100, the tube 146 is positioned along an upper portion of the support assembly 140, such that during operation of the pump 142, air travels upwards from the pump 142, through the tube 146, and into the air bladder 128. In umbrella 100, the pump 142 is a piston pump that drives air into the toroidal air bladder when a user manually cycles an internal piston (e.g., using an appropriate handle). The pump 142 also includes a valve (e.g., a one-way valve or check valve) that prevents air from escaping from the air bladder 128. The valve is releasable, such that air contained within air bladder 128 can be controllably released from the air bladder 128. In some cases, the pump 142 includes a valve that automatically releases air from the air bladder 128 when the air pressure within them exceeds a particular threshold (e.g., 20 psi). Pumps are discussed in greater detail below.

The handle 144 acts as a grasping surface for the user. The handle 144 is positioned along a lower portion of the support assembly 140. In some umbrellas, the handle 144 is integral with the pump 142, such that the user can use the handle 144 to operate the pump 142 during deployment of the umbrella (e.g., to cycle the pump 142 and inflate the air bladder 128), as well as to grasp the umbrella before and after deployment. In some cases, the handle 144 is separate from the pump 142, such that the user grasps the handle 144 to position the umbrella 100 during use, and separately grasps a pump 142 during its operation.

In an example usage of the umbrella 100, the umbrella is initially in a stowed position. In the stowed position, the support ribs 124 are substantially parallel to the support assembly 140 (or at a relatively small angle with respect to the support assembly 140), and the sheet 126 drapes loosely from the support ribs 124. The user deploys the canopy assembly by cycling the pump 142 using the handle 144 (e.g., by alternatively pushing the handle 144 towards the pump 142 and pulling the handle 144 away from the pump 142), driving air into the pump 142, through the tube 146, and into the air bladder 128. As the air bladder 128 inflates, the air bladder 128 expands, pressing the support ribs 124 outwards, such that they pivot outward from the support assembly 140 about the joints 130. In the fully deployed position, the sheet is 126 is tightly drawn between the support ribs 124, forming a protective canopy. If desired, the user can continue driving additional air into the air bladder 128, increasing the rigidity of air bladder 128 and further strengthening the umbrella 100 in its deployed configuration. The user then grasps the umbrella 100 by the handle 144, and positions the umbrella 100 as desired. When deployed, the sheet 126 provides the user with a protective shield against the elements. For example, the user can position his body within the protected region 160 to shield himself from rain and/or sunlight. As the umbrella 100 is portable, the user can carry the umbrella 100 as he walks, such that he remains protected during travel. When finished using the umbrella 100, the user releases the valve of pump 142, releasing air from the air bladder 128. Once the air bladder 128 is deflated, the umbrella 100 returns to the stowed configuration.

Figure 2:
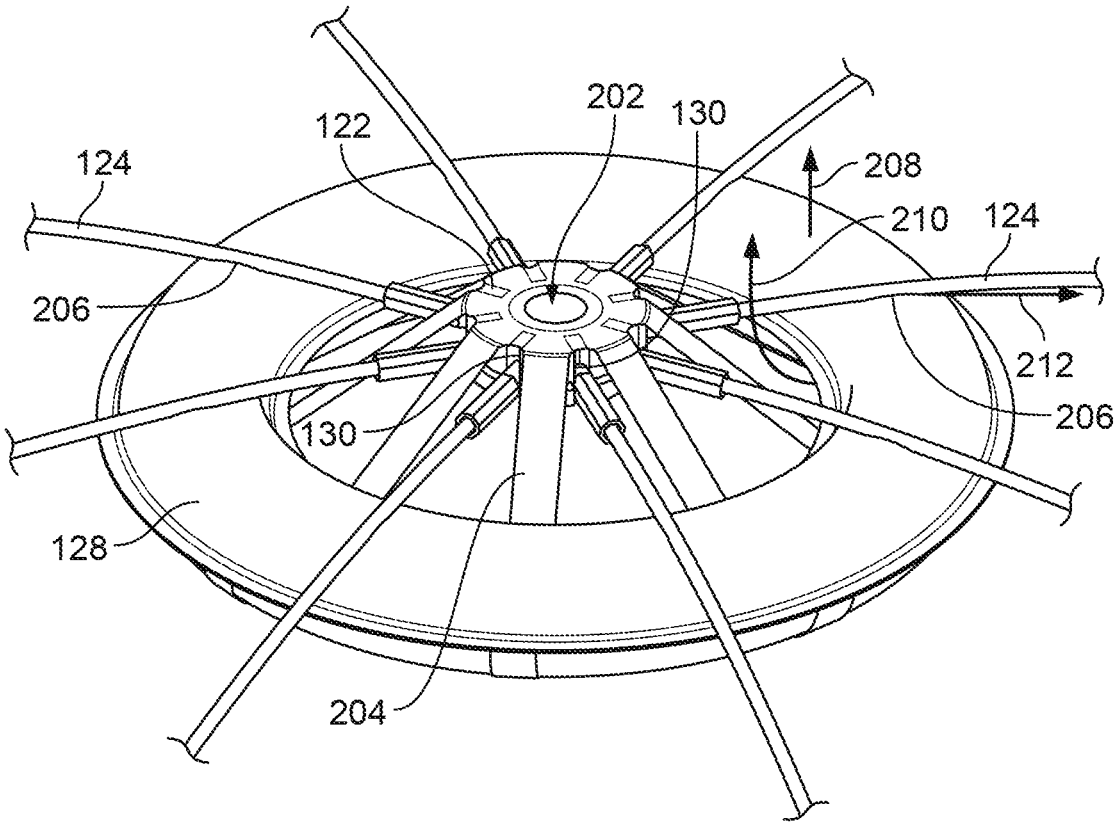
FIG. 2 is a perspective view of a hub.

FIG. 2 shows a detailed view of the hub 122, support ribs 124, air bladder 128, and joints 130 when the umbrella 100 is in a deployed configuration. As described above, the hub 122 provides a central attaching point for components of the canopy assembly (e.g., the support ribs 124 and air bladder 128), and attaches the canopy assembly 120 and the support assembly 140 to each other. The hub 122 is generally toroidal in shape, and defines a channel 202 through its center. Channel 202 engages a corresponding structure on the support assembly 140 (e.g., a peg, pin, or dowel that extends from the upper end of the support assembly 140), such that the hub 122 is secured atop the support assembly 140.

As described above, several support ribs 124 are attached to the hub 122 through joints 130. The joints 130 are hinged joints, allowing each of the support ribs 124 to pivot with substantially one degree of freedom with respect to the hub 122. As also shown in FIG. 2, each support rib 124 extends radially outward from the hub 122 at approximately equidistant points about the outer periphery of hub 122.

As described above, the air bladder 128 provides a mechanism for controllably pivoting the support ribs 124 between the stowed position and the deployed position. As shown in FIG. 2, when the umbrella 100 is in a deployed configuration and the air bladder 128 is inflated, the air bladder 128 contacts each of the support ribs 124 (e.g., at points 206), supporting the support ribs 124 at the deployed position. In this example, the air bladder 128 is generally toroidal when inflated, and is positioned slightly below the hub 122.

The air bladder 128 is attached to the hub 122, such that the air bladder 128 and hub 122 remain coupled whether the air bladder 128 is deflated or inflated. The air bladder is 128 is attached to the hub 122 through several support straps 204; the support straps 204 extend between the air bladder 128 and the hub 122. In some umbrellas, the support straps 204 extend from the upper surface of the hub 122 to the lower surface of the air bladder 128. In this arrangement, the air bladder 128 is pulled upward when inflated (e.g., in the direction of arrow 208), and applies force to the underside of the support ribs 124. This increases the rigidity of the protective canopy, and in some cases, also increases the curvature of the protective canopy. Further, in this arrangement, the air bladder 128 rotates when inflated (e.g., in the direction of arrow 210). If the air bladder 128 is also secured to the sheet 126 (e.g., at the points 206), this rotation applies an outward force to each of the support ribs 124 (e.g., in the direction of arrow 212), and further increases the rigidity of the protective canopy.

Although shown and described above, umbrella 100 is merely an illustrative example. In practice, umbrellas vary in configuration from umbrella 100. For example, the umbrella 100 has support ribs 124 that bow or arc to a particular degree when in a deployed position. In practice, support ribs 124 can bow to a greater or lesser degree, depending on the implementation. In some umbrellas, the support ribs 124 bow to a greater degree than shown in FIG. 1A and FIG. 1B, and define a deeper canopy assembly 120 when deployed. In some umbrellas, the support ribs 124 bow to a lesser degree than shown in FIG. 1A and FIG. 1B, and define a flatter canopy assembly 120 when deployed. In some umbrellas, the support ribs 124 do not bow at all, and extend in a substantially straight direction from the hub 122.

As another example, the overall shape of the canopy assembly 120 can also vary. For example, when in the deployed configuration, the umbrella 100 is shown having support ribs 124 and sheet 126 that define a curved canopy (e.g., roughly approximating the surface of a spherical sector). In some umbrellas, the support ribs 124 and sheet 126 define canopies having a different surface arrangement, such example a conical surface, a pyramidal surface, or an arbitrary symmetrical or asymmetrical surface.

As another example, the umbrella 100 is shown having support ribs 124 that extend from hub 122 approximately perpendicular to the extension of support assembly 140 when in the deployed configuration. In practice, when the support ribs 124 are in the deployed configuration, the support ribs 124 can extend from hub 122 to a greater or lesser degree than that shown. For example, in some umbrellas, when the support ribs 124 are in the deployed configuration, the support ribs 124 extend from the hub 122 at an angle less than 90° (e.g., 60°, 70°, or 80°) or greater than 90° (e.g., 100, 120°, or more).

As another example, the umbrella 100 can have different numbers of support ribs 124. For example, FIG. 2 shows eight support ribs 124. Some umbrellas have fewer support ribs 124 (e.g., 4, 5, 6, or 7) and some have more support ribs (e.g., 9, 10, 11, 12, or more). Umbrellas can also have a different number of support straps 204. For example, FIG. 2 shows eight support straps 204. Some umbrellas have fewer support straps 204 (e.g., 4, 5, 6, or 7), and some umbrellas have more support straps 204 (e.g., 9, 10, 11, 12, or more).

Figure 3A:
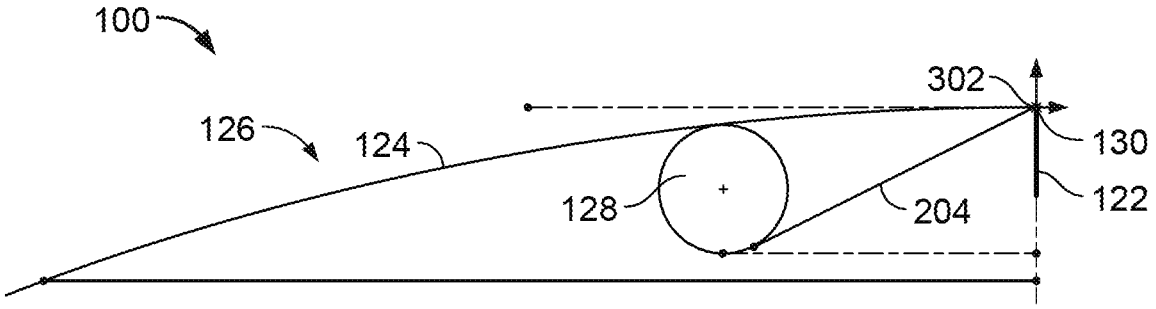
FIGS. 3A-C are cross-sectional views of upper portions of an umbrella.
Figure 3B:
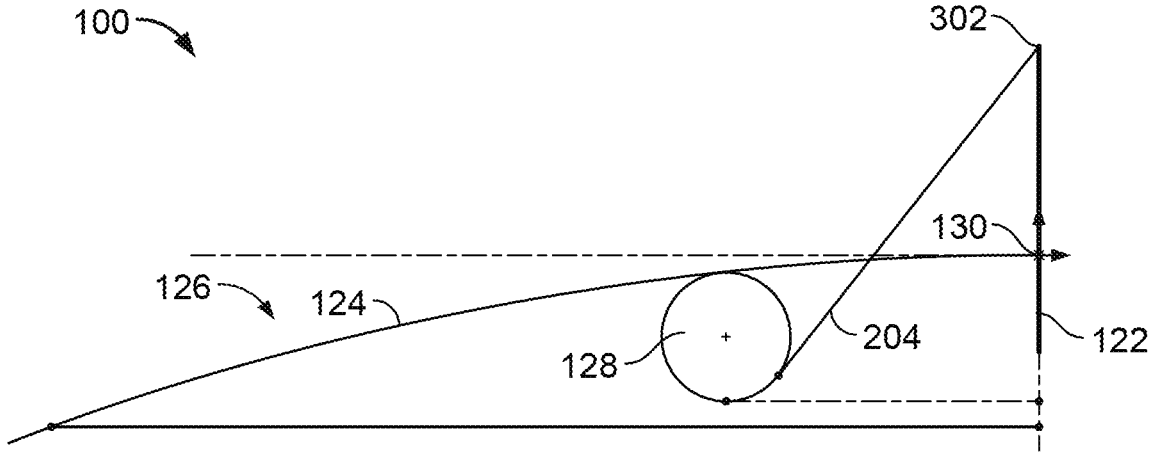
Figure 3C:
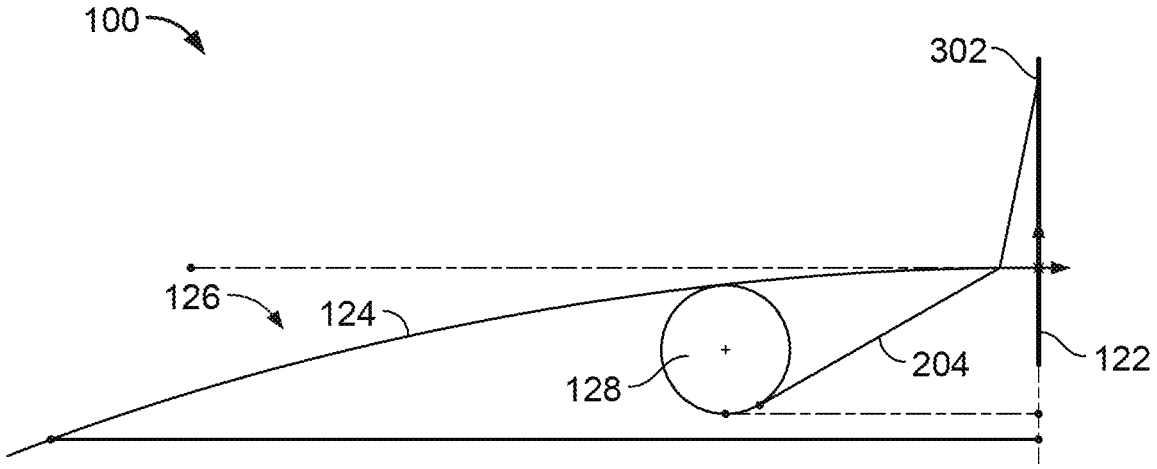

FIG. 2 shows the support straps 204 attached to the hub 122 at a point slightly above the joints 130. In practice, the shape and position of the hub 122 can differ, and the supports straps 204 can be attached to hub 122 at different points relative to joints 130. For instance, FIG. 3A shows a hub 122 that is relatively thin, and the support straps 204 are attached to the hub 122 at a point 302 approximately the same height as joint 130. In contrast, FIG. 3B shows a hub 122 that is relatively thick, and the support straps 204 pass through the sheet 126 (e.g., through seams or eyelets in sheet 126) and are attached to the hub 122 at a point 302 substantially above the joint 130. FIG. 3C shows support straps 204 that pass through the sheet 126 (e.g., through seams or eyelets in sheet 126), bend after passing through the sheet 126, and are attached to the hub 122 at a point 302 substantially above the joint 130. In some umbrellas, a cap is attached to the top of the hub 122 to secure the support straps 204 and the hub 122 to the support assembly 140.

Figure 4A:
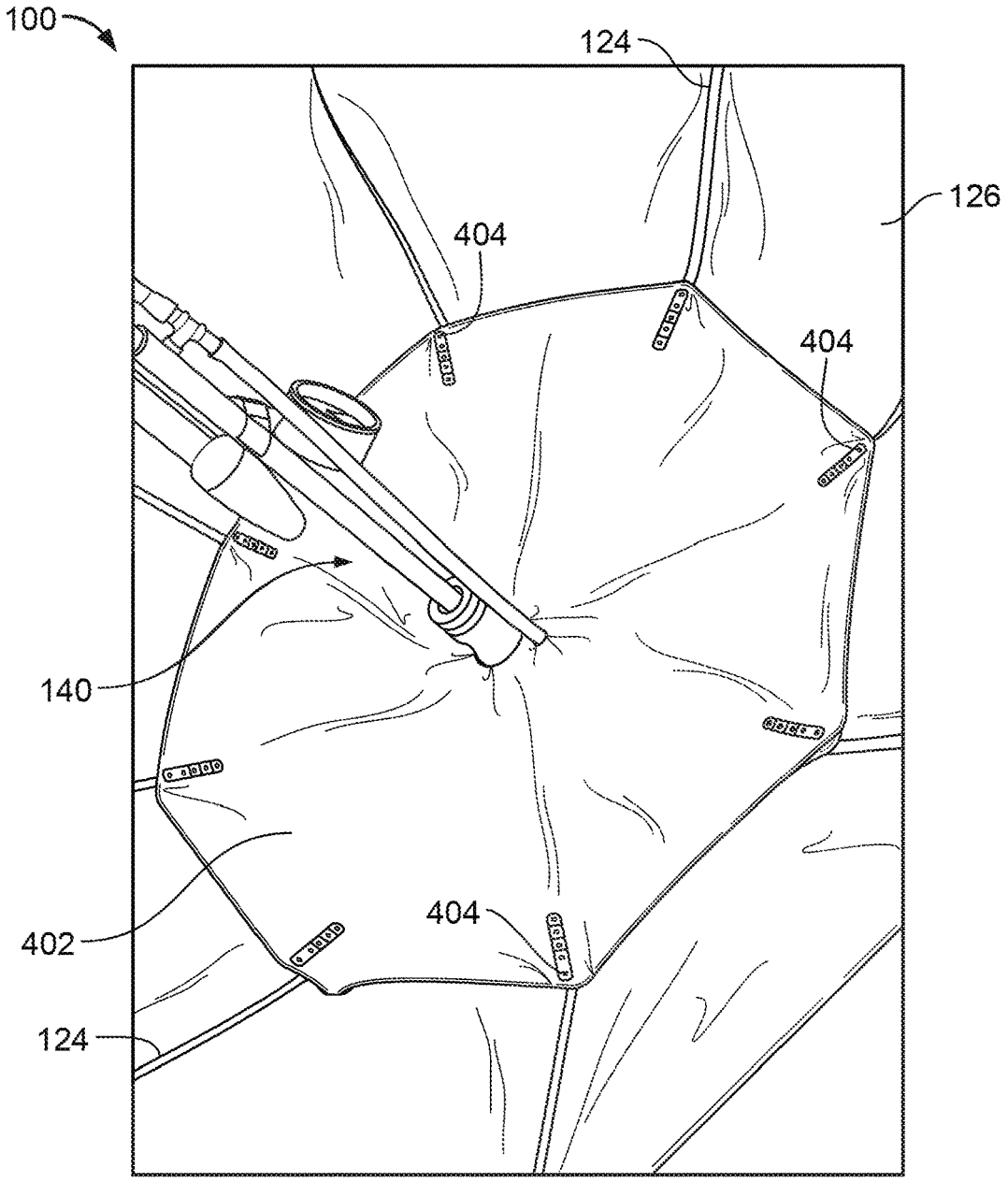
FIG. 4A and FIG. 4B are, respectively, a perspective view and a cross-sectional view of a portion of an umbrella with a stabilizer.
Figure 4B:
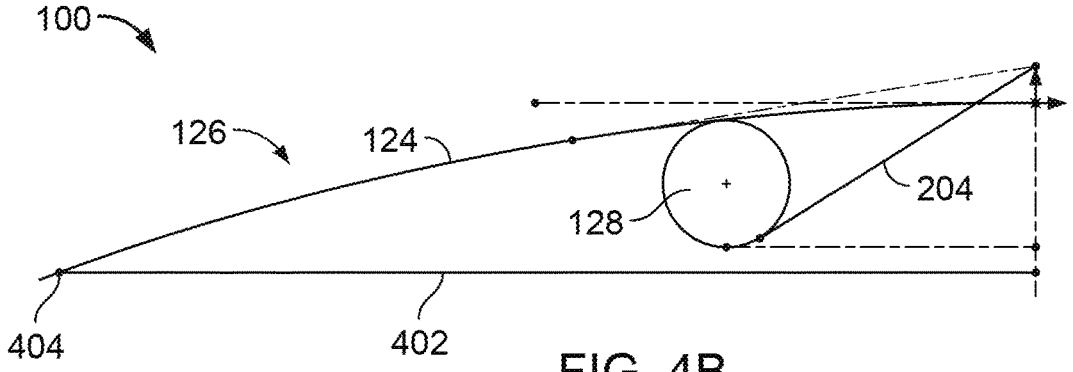

As discussed above, some umbrellas include a stabilizer that is attached to the support ribs 124, which limits the range of motion of the support ribs 124. In some cases, the stabilizer 402 is sheet that extends between the support ribs 124 and the support assembly 140. FIG. 4A and FIG. 4B show a stabilizer 402 that is attached to a point 404 on each of the support ribs 124 along the underside of the sheet 126. When the umbrella 100 is deployed, the stabilizer 402 is tightly drawn across each of the points 404 and the support assembly 140, limiting the support ribs 124 from pivoting any further with respect to the support assembly 140. This additional attachment point further limits the support ribs 124 from pivoting any further with respect to the support assembly 140, and increases the stability of the umbrella 100 when external forces are applied to the canopy. In addition to limiting the range of motion of the support ribs 124, the stabilizer 402 also covers the hub 122. This protects the hub 122 from damage, and hides the hub 122 from view to provide a more aesthetically pleasing appearance.

Stabilizer 402 can be used, for example, to prevent the support ribs 124 from pivoting beyond a particular range with respect to the extension of the support assembly 140. For example, the stabilizer can prevent the support ribs 124 from over-pivoting due to over inflation of the air bladder 128 or due to external force (e.g., wind blowing on the underside of the umbrella 100). In this manner, when deployed, the shape of the canopy assembly 120 is preserved despite misuse by a user, inclement weather, and/or other external forces. In some cases, the stabilizer 402 is flexible, collapsible, or foldable, such that it can be folded, crushed, or otherwise collapsed as the umbrella is closed.

In some cases, the stabilizer 402 is attached to the support assembly 140 through a stabilizer mount (e.g., a cylindrical ring) that can move along the shaft of the support assembly 140. This allows the user to collapse the protective canopy, in part, by pulling downward on the stabilizer mount. As the stabilizer mount moves downward along the support assembly 140, the stabilizer 402 pulls the support ribs 124 from their deployed positions. The user continues pulling downward on the stabilizer mount until the support ribs 124 are parallel to the shaft of the support assembly 140, thereby collapsing the protective canopy. Conversely, as the umbrella 100 is being deployed, the stabilizer mount is pulled upward by the support ribs 124 and stabilizer 402 along the shaft of the support assembly 140. The stabilizer mount continues moving upward until the umbrella is fully deployed, or in some cases, until the stabilizer mount is limited from moving upward any further (e.g., until it contacts a blocking element that prevents further upward movement of the stabilizer mount with respect to the support assembly 140).

Figure 5A:
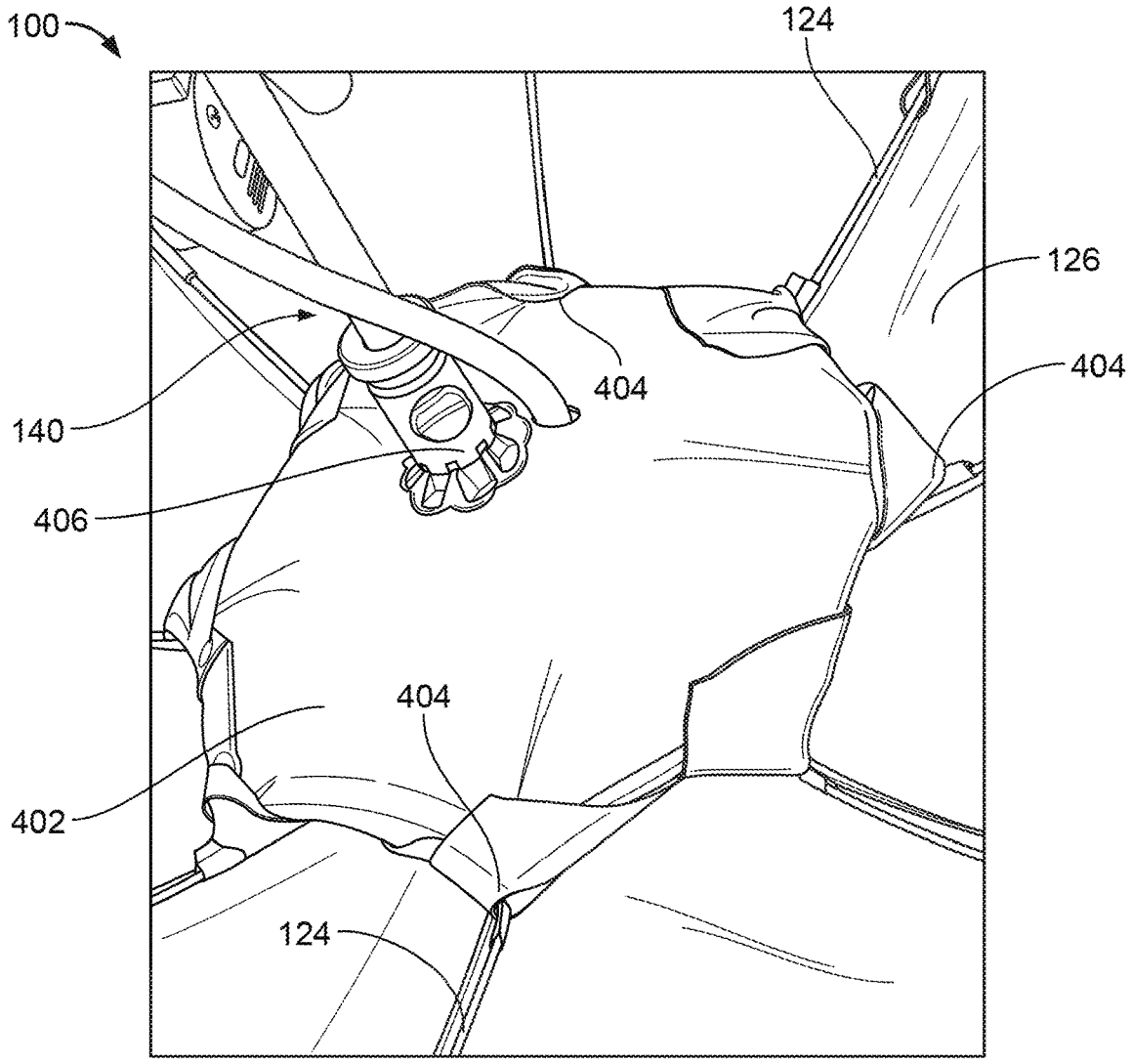
FIG. 5A and FIG. 5B are, respectively, a perspective view and a cross-sectional view of a portion of an umbrella with a stabilizer.
Figure 5B:
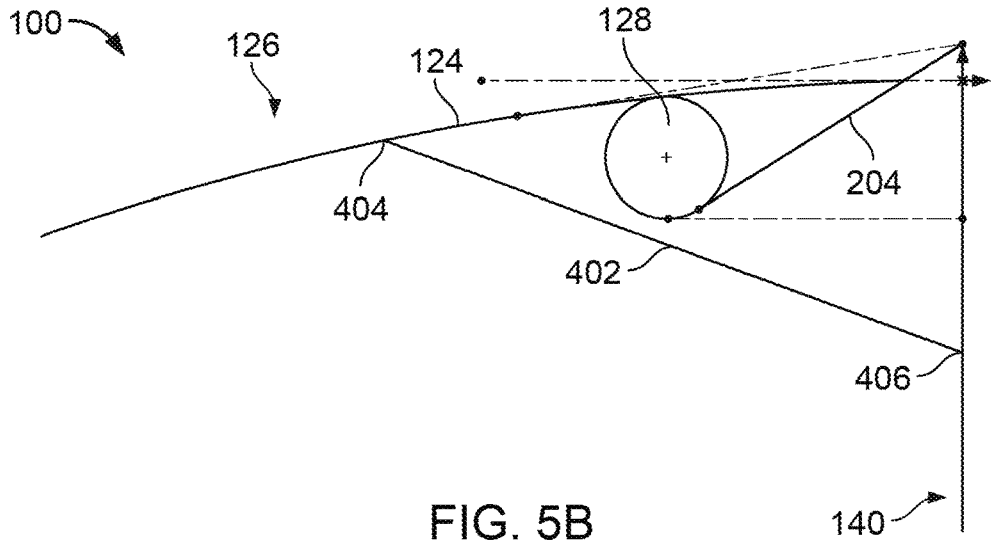

FIG. 4A and FIG. 4B show a stabilizer 402 that is substantially flat when the umbrella 100 is in the deployed position. However, this need not be the case. For example, FIG. 5A and FIG. 5B show an umbrella 100 with a stabilizer 402 that is attached to a point 404 on each of the support ribs 124 along the underside of the sheet 126. When the umbrella 100 is deployed, the stabilizer is also tightly drawn across each of the points 404, limiting the support ribs 124 from pivoting any further with respect to the support assembly 140. However, the stabilizer is also attached to the support assembly 140 at a point 406 substantially below points 404. Thus, when the stabilizer 402 is tightly drawn across points 404 and 406, the stabilizer is substantially not flat. Other arrangements of the stabilizer 402 are also possible, depending on the implementation.

Figure 6A:
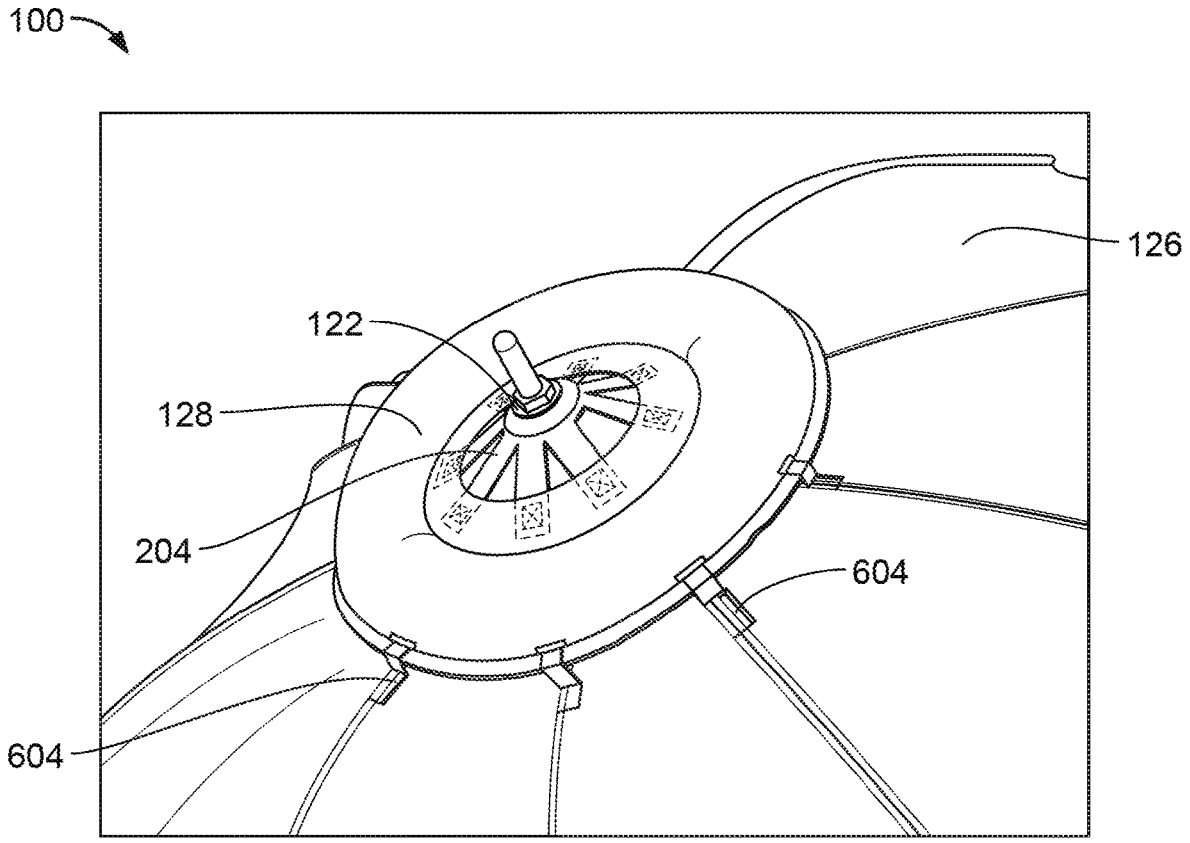
FIG. 6A and FIG. 6B are, respectively, a perspective view and a cross-sectional view of a portion of an umbrella with a hub positioned along the upper side of a sheet.
Figure 6B:
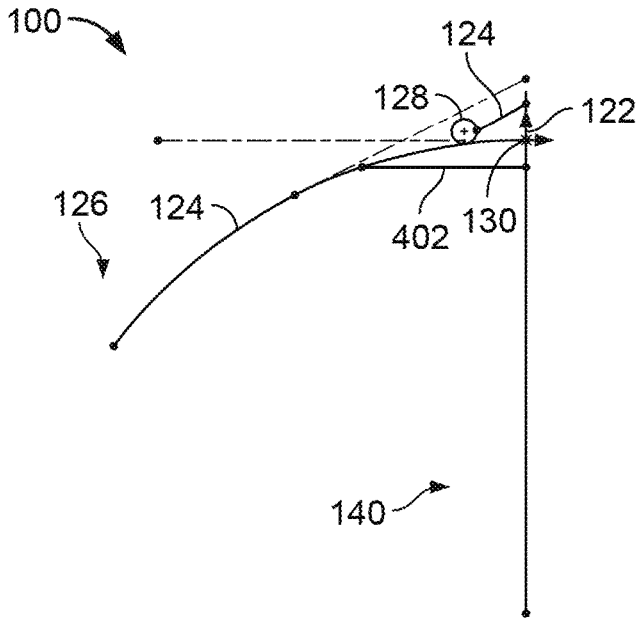

In the examples described above, the air bladder 128 is positioned along an underside of sheet 126, such that when air bladder 128 is inflated, the air bladder 128 pushes the support ribs 124 away from the support assembly 140. In some umbrellas, the air bladder 128 is instead positioned along the upper side of sheet 126. For example, as shown in FIG. 6A and FIG. 6B, an air bladder 128 can be positioned along the upper side of sheet 126, and above the support ribs 124. The air bladder 128 is attached to each of the support ribs 124 by a series of support straps 602 that pass through the sheet 126 (e.g., through seams or eyelets 604 in sheet 126). In this implementation, the hub 122 is also positioned on the upper side of sheet 126, and is attached to the air bladder 128 through support straps 204.

In this example, when the air bladder 128 is deflated, the air bladder 128 does not have a substantially rigid form, and the support ribs 124 hang from the hub 122 in a direction substantially parallel to the support assembly 140 (or at a relatively small angle with respect to the support assembly 140). When partially inflated, the air bladder 128 increases in rigidity, and enlarges about the support assembly 140. As the air bladder 128 inflates, the enlarging air bladder 128 pulls the support ribs 124 away from the support assembly 140. This pulling force causes the support ribs 124 to pivot at joints 130 with respect to the hub 122, extending the support ribs 124 at an angle with respect to the support assembly 140. As the air bladder continues 128 to inflate, the support ribs 124 are pulled further and further outward, until the support ribs 124 are in a fully deployed position. In the fully deployed position (e.g., as shown in FIG. 6A and FIG. 6B), the sheet is 126 is tightly drawn between the support ribs 124, forming a protective canopy. In this example, the umbrella 100 also includes a stabilizer 402 that is tightly drawn across the support ribs 124, preventing the support ribs 124 from pivoting further with respect to the hub 122 and the support assembly 140.

Figure 7A:
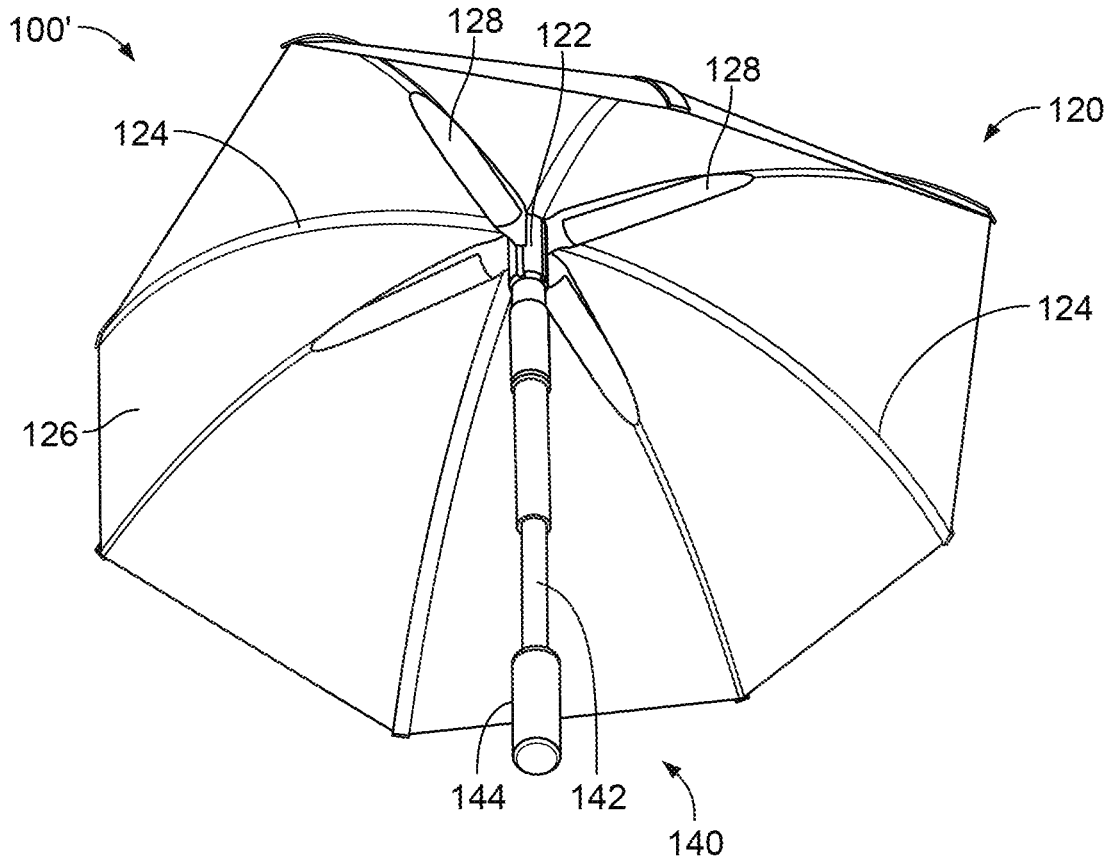
FIG. 7A and FIG. 7B are, respectively, a perspective view and a cross-sectional view of an umbrella.
Figure 7B:
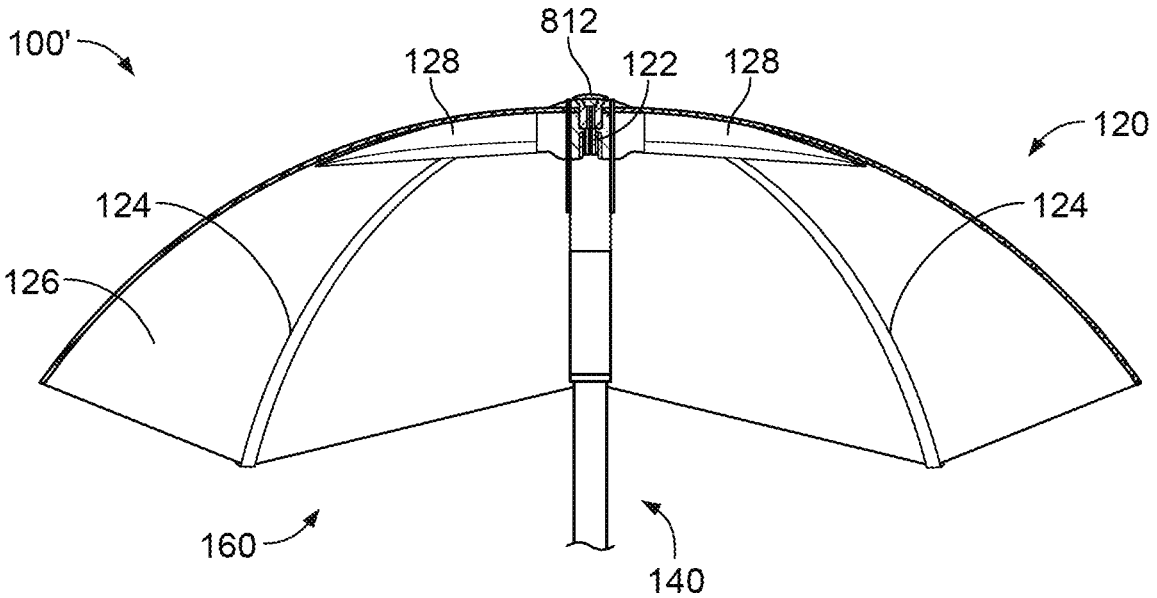

Although umbrella 100 is shown as having a toroidal air bladder 128 in the above examples, some umbrellas 100 have air bladders that inflated into other shapes, such as straight beams and curved beams. An umbrella 100' having multiple straight inflatable members is shown in FIGS. 7A and 7B. The umbrella 100' includes a canopy assembly 120 and a support assembly 140. The canopy assembly 120 includes a hub 122, several support ribs 124, a sheet 126, and several air bladders 128. The support assembly 140 includes a pump 142 and a handle 144.

Figure 8A:
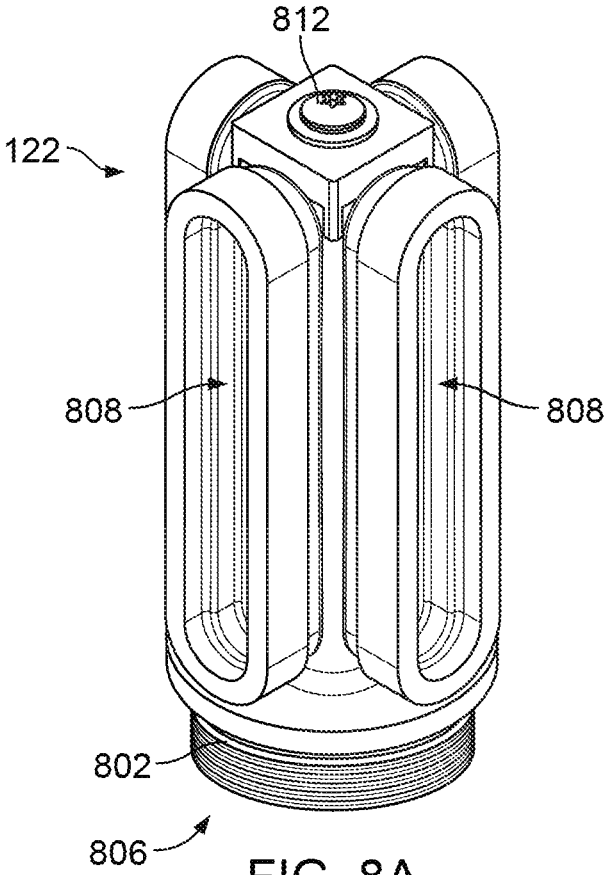
FIG. 8A and FIG. 8B are, respectively, a perspective view and a cross-sectional view of an umbrella hub.
Figure 8B:
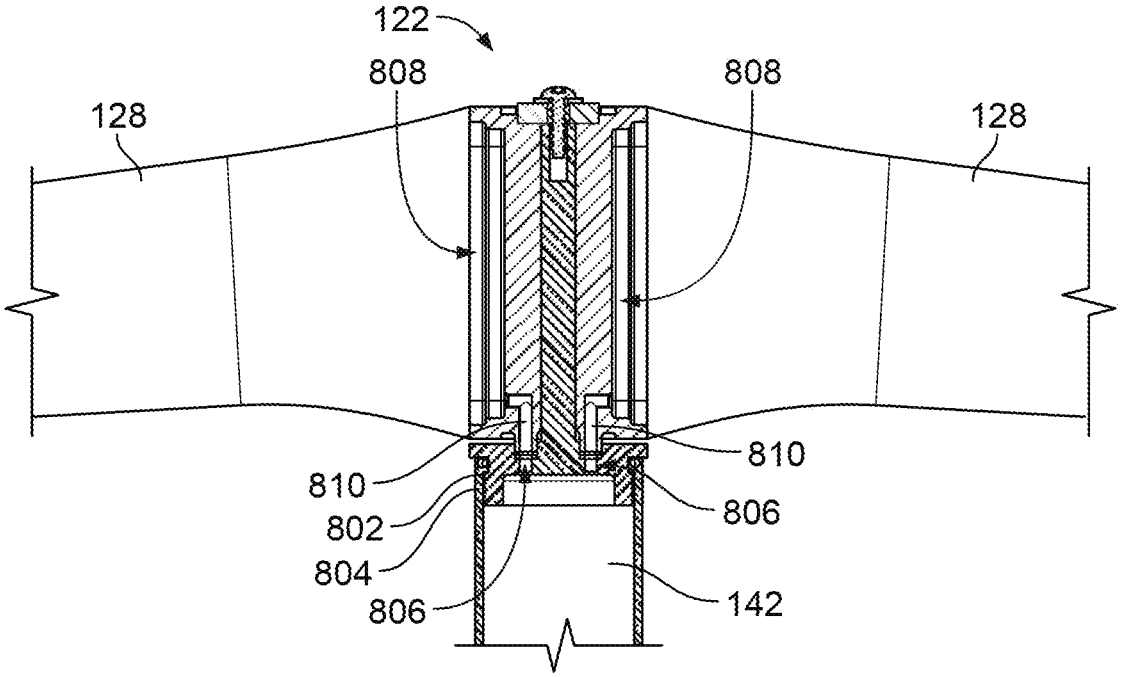

As above, the hub 122 provides a central attachment point for components of the canopy assembly 120, and attached the canopy assembly 120 and the support assembly 140 to each other. FIG. 8A and FIG. 8B show a hub 122 that is fixed to an upper portion of the support assembly 140 through corresponding screw threads 802 and 804. Hub 122 includes several bottom apertures 806 and several side apertures 808. Each bottom apertures 806 is coupled with a side apertures 808 by an interior channel 810, defining an air-tight passageway between each bottom aperture 806 and its corresponding side aperture 808.

The support ribs 124 provide structural support for the canopy assembly. Each support rib 124 is a rod or strip that is attached on one end to the hub 122, and extends radially outward from the hub 122. Each support rib 124 is attached to the hub 122 through a screw 812. The support ribs 124 are flexible, and can bend between a stowed position (e.g., such that the support rib 124 extends in a direction approximately parallel to the extension of the support assembly 140) and a deployed position (e.g., such that the support rib 124 extends in a direction that is angled to a particular degree, such as 90°, with respect to the extension of the support assembly 140). As shown in FIG. 7A and FIG. 7B, when the support ribs 124 are in a deployed position, each support ribs 124 bows downward, forming an arc or curve.

The sheet 126 provides a protective region 160 below the canopy assembly. In some implementations, the sheet 126 is similar to the examples described above. For example, the sheet 126 can be attached each of the support ribs 124, and extends between adjacent support ribs 124. When the support ribs 124 are in a stowed position, the sheet 126 is loosely draped from each of the support ribs 124. When the support ribs 124 are extended to a deployed position, the sheet 126 extends with the support ribs 124, and is tightly drawn between the support ribs 124, forming the protective region 160 below the canopy assembly.

The air bladders 128 provide a mechanism for controllably adjusting the umbrella 100' between the stowed position and the deployed position. Each air bladder 128 is generally in the shape of a narrow beam, and is attached to a corresponding side aperture 808 of the hub 122. Each air bladder 128 is also attached to a support rib 124, and extends along the underside of sheet 126 radially outward from the center of sheet 126. The air bladder 128 is substantially air tight, and can be fully or partially inflated such that its internal volume is filled with pressurized or compressed air relative to the ambient environment, or deflated such that its internal volume does not contain compressed air. When deflated, the air bladders 128 do not have a substantially rigid form, and the support ribs 124 hang from the hub 122 in a direction substantially parallel to the support assembly 140. The umbrella 100' provides perpendicular stability of the inflated sheet 126 and the support assembly 140 is achieved without a stability sheet 402 as the aperture 808 is rigidly mounted to the support assembly 140 and resists movement of the sheet 126 relative to the support assembly 140 (e.g., the shaft of the handle). In some cases, this connection between the support assembly 140 and the hub 122 allows the umbrella 100' to resist external forces (e.g., wind). In some cases, the stabilizer 402 is flexible, collapsible, or foldable, such that it can be folded or crushed as the umbrella is collapsed. In some cases, the air bladders 128 are flexible, collapsible, or foldable, such that they can be folded, crushed, or otherwise collapsed as the umbrella is closed.

When partially inflated, the air bladders 128 increase in rigidity. As the air bladders 128 inflate, the enlarging air bladders 128 pushes the support ribs 124 away from the support assembly 140. This pushing force causes the support ribs 124 to extend at an angle with respect to the support assembly 140. As the air bladders 128 continue to inflate, the support ribs 124 are pushed further and further outward, until the support ribs 124 are in a fully deployed position. In the fully deployed position (e.g., as shown in FIG. 7A and FIG. 7B), the sheet is 126 is tightly drawn between the support ribs 124, forming a protective canopy. The air bladders 128 can each have varying degrees of rigidity, depending on the amount of air compressed within them. As such, the rigidity of the umbrella 100' can be varied by driving more or less air into the air bladders 128.

The pump 142 is coupled to the air bladders 128 and allows air to be pumped from outside the umbrella 100' (e.g., from the ambient environment) into the air bladders 128. As described above, the pump 142 can be coupled to the air bladders 128 through channels defined by lower apertures 806, interior channels 810, and side apertures 808, which provide air-tight channels for air to travel between the pump 142 and each of the air bladders 128. The pump 142 can be similar to the pumps described above. For example, in some implementations, the pump 142 is a piston pump that drives air into the air bladders 128 when a user manually cycles an internal piston (e.g., using an appropriate handle). The pump 142 also includes several valves (e.g., one-way valves or check valves) coupled to each of the lower apertures 806 that prevent air from escaping from the air bladders 128. The valves are releasable, such that air contained within air bladders 128 can be controllably released from the air bladders 128. In some cases, the pump 142 includes a valve that automatically releases air from the air bladders 128 when the air pressure within them exceeds a particular threshold (e.g., 20 psi). Pumps are discussed in greater detail below.

The handle 144 acts as a grasping surface for the user. In the some implementations, the handle 144 is similar to the handles 144 described above. For example, FIGS. 7A and 7B show a handle 144 that is positioned along a lower portion of the support assembly 140. In some implementations, the handle 144 is integral with the pump 142, such that the user can use the handle 144 to interact with the pump 142 during deployment of the umbrella (e.g., to cycle the pump 142 and inflate the air bladder 128), as well as to grasp the umbrella before and after deployment.

In an example usage of the umbrella 100', the umbrella is initially in a stowed position. In the stowed position, the support ribs 124 are substantially parallel to the support assembly 140, and the sheet 126 drapes loosely from the support ribs 124. The user deploys the canopy assembly by cycling the pump 142 using the handle 144 (e.g., by alternatively pushing the handle 144 towards the pump 142 and pulling the handle 144 away from the pump 142), driving air into the pump 142 and into each of the air bladders 128. As the air bladders 128 inflate, the air bladders 128 expand, pressing the support ribs 124 outwards from the support assembly 140. In the fully deployed position, the sheet is 126 is tightly drawn between the support ribs 124, forming a protective canopy. If desired, the user can continue driving additional air into the air bladders 128, increasing the rigidity of air bladders 128 and further strengthening the umbrella 100' in its deployed configuration. The user then grasps the umbrella 100' by the handle 144, and positions the umbrella 100' as desired. When deployed, the sheet 126 provides the user with a protective shield against the elements. For example, the user can position his body within the protective region 160 to shield himself from rain and/or sunlight. As the umbrella 100' is portable, the user can carry the umbrella 100' as he walks, such that he remains protected during travel. When the user is finished using the umbrella 100', the user releases the valve of pump 142, releasing air from the air bladders 128. Once the air bladders 128 are deflated, the umbrella 100' returns to the stowed configuration.

Figure 9:
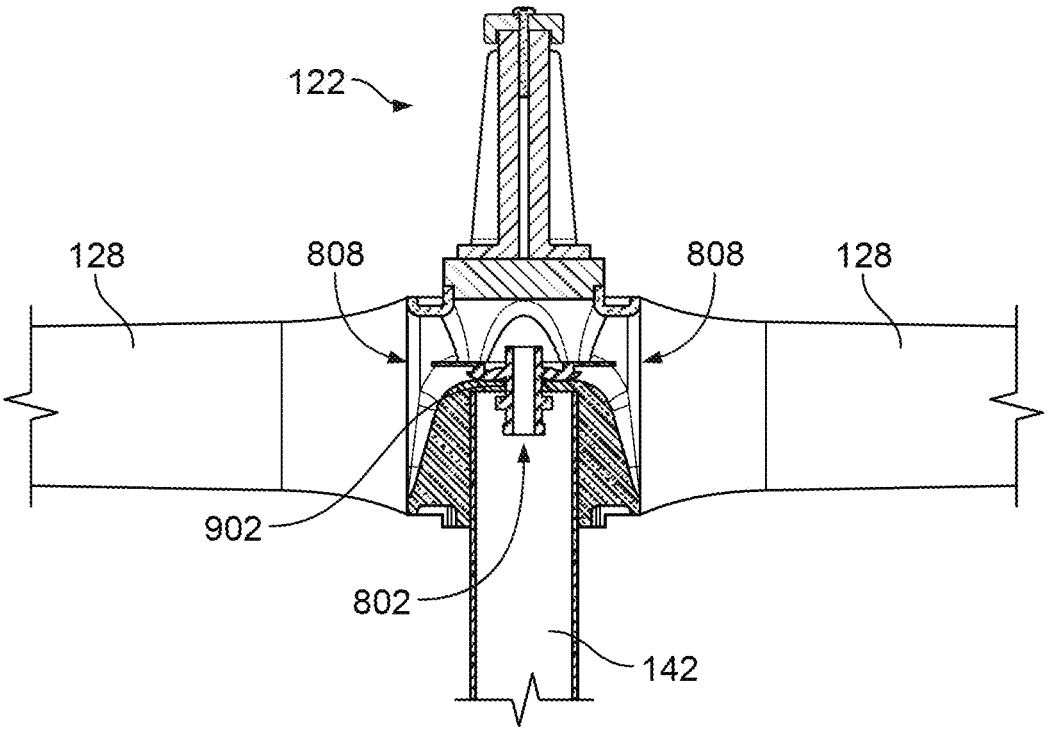
FIG. 9 is a cross-sectional view of an umbrella hub.

Although FIG. 7A, FIG. 7B, FIG. 8A, and FIG. 8B show example umbrellas having multiple straight inflatable members, these are merely illustrative examples. In practice, umbrellas can differ from those shown above. For example, FIG. 8A and FIG. 8B show a hub 122 having multiple corresponding side apertures 808 and bottom apertures 806, such that air from the pump 142 is driven into each air bladder 128 through an individually defined air channel. In some implementations, the hub 122 instead has fewer bottom apertures 806 than side apertures 808. For example, FIG. 9 shows a hub 122 has only a single bottom aperture 806 coupled to multiple side apertures 808. The pump 142 is coupled to the bottom aperture 806 and the air bladders 128 are coupled to each of the side apertures 808, such that during operation of the pump 142, air travels upwards from the pump 142 and into each of the air bladders 128. In the example shown here, the hub 122 also includes a valve 902 that prevents air from escaping from the air bladders 128. The valve 902 is releasable, such that air contained within air bladders 128 can be controllably released from the air bladders 128. In some umbrellas, the valve 902 can replace one or more valves of the pump 142, such that only a single valve need to needed to regulate air flow into and out of the air bladders 128.

Figure 10:
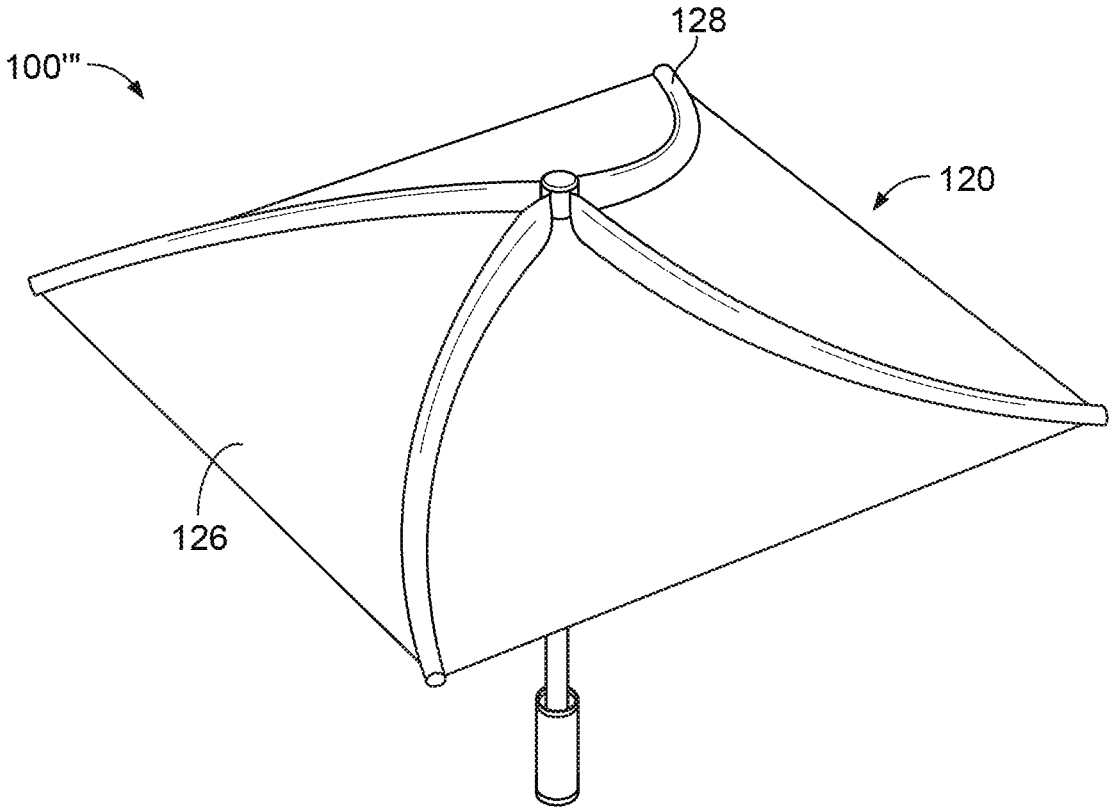
FIG. 10 is a perspective view of an umbrella.

In some implementations, the shape of the canopy assembly 120 can vary from the examples described above. For instance, FIG. 10 shows an umbrella 100" in which the canopy assembly 120 has a generally pyramidal shape defined by the sheet 126 and the air bladder 128. In practice, other shapes for the canopy assembly 120 are also possible.

The shape of the air bladder 128 can also vary from the examples described above. For instance, FIG. 10 shows air bladders 128 that are curved, each forming a portion of a spiral. In practice, other shapes for the air bladders 128 are also possible.

Figure 11:
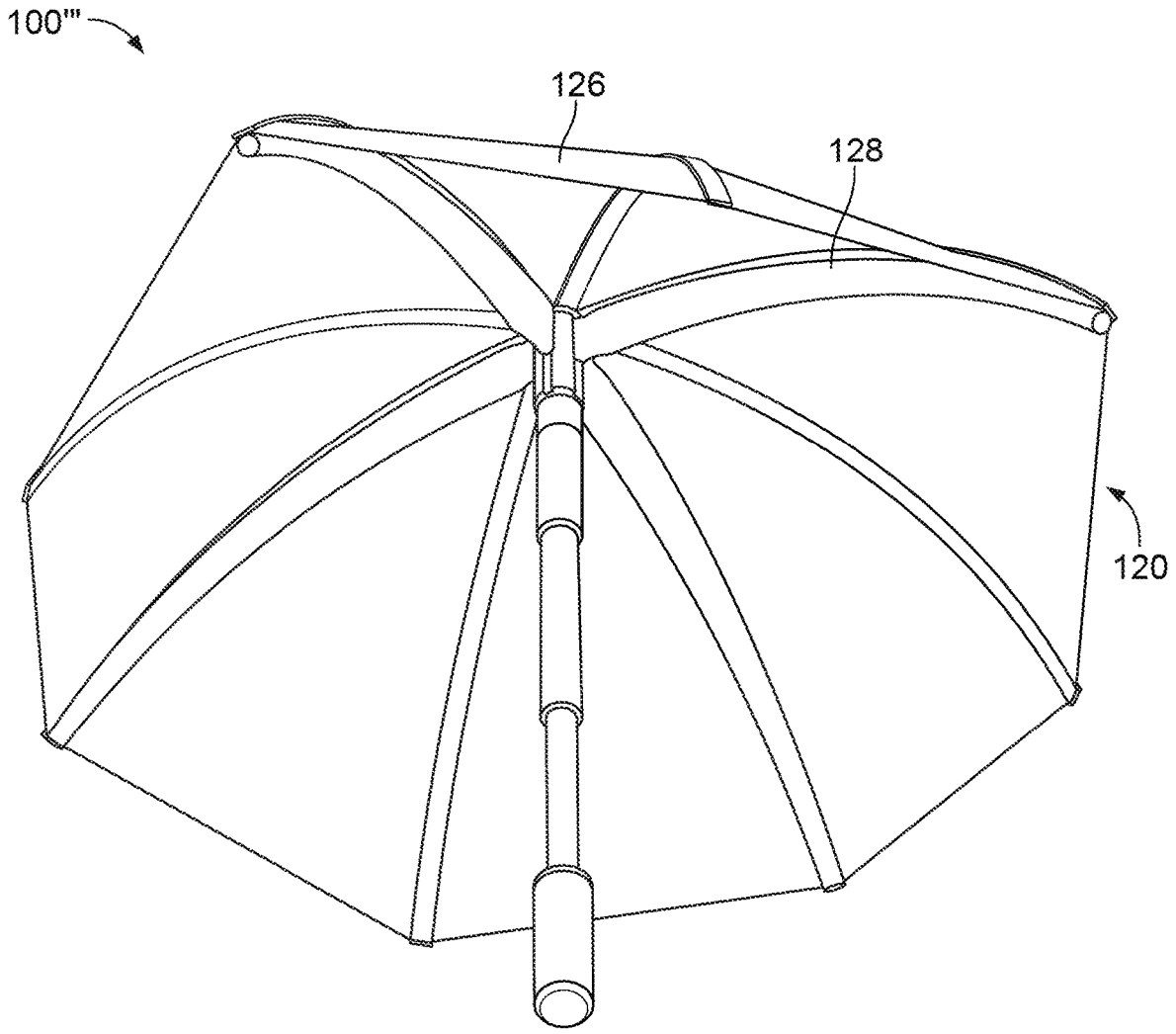
FIG. 11 is a perspective view of an umbrella.

Not all umbrellas include support ribs 124. For instance, FIG. 11 shows a umbrella 100''' in which the canopy assembly 120 does not include any support ribs, and the sheet 126 is instead attached to each of the air bladders 128. When the air bladders 128 are inflated, the sheet 126 is tightly drawn between the air bladders 128, forming a protective canopy. In some circumstances, umbrellas that do not have any support ribs are relatively more resilient than umbrellas with support ribs, and are more resistant to wind or other potentially damaging external forces.

In some umbrellas (e.g., umbrella 100' shown in FIG. 7A and FIG. 7B), the air bladders 128 do not fully extend to the periphery of the sheet 126. In contrast, FIG. 11 shows air bladders 128 that fully extend to the periphery of the sheet 126. Further, the air bladders 128 need not be straight, and can be curved. For example, FIG. 11 shows the air bladders are curved to provide the canopy assembly 120 with a curved shape. In practice, air bladders 128 can vary in shape, size, and/or arrangement to provide canopy assemblies having different shapes and sizes.

As described above, an umbrella (e.g., an umbrella 100, 100', 100", or 100''') includes a pump 142 operable to compress air from outside the umbrella into one or more air bladders. In practice, a pump 142 can have different arrangements, depending on the implementation.

Figure 12A:
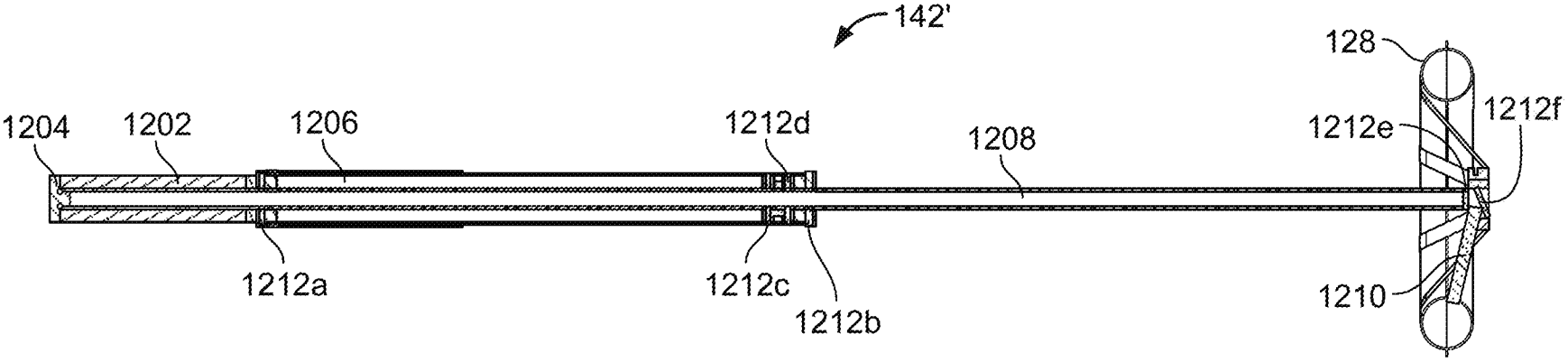
FIGS. 12A-E are cross-sectional views of an umbrella pump.

As an example, a pump 142' is schematically shown in FIG. 12A. The pump 142' includes a handle 1202, a shaft chamber seal 1204, a pump chamber 1206, a shaft chamber 1208, a hose 1210, and check valves 1212*a-f*.

The pump chamber 1206, the shaft chamber 1208, and the hose 1210 are interconnected (i.e., in fluid communication with each other), such that air can flow between them. The hose 1210, in turn, is connected to an air bladder 128, such that air from the pump chamber 1206, the shaft chamber 1208, and the hose 1210 can be compressed into the air bladder 128.

The flow of air into, out of, and within the pump 142' is regulated by check valves 1212*a-f*. The check valves 1212*a* and 1212*b* are positioned at opposite ends of the pump chamber 1206, and regulate the flow of air from outside the pump 142' into pump chamber 1206. The check valves 1212*b* and 1212*c* are each positioned between the pump chamber 1206 and the shaft chamber 1208, and regulate the flow of air between the pump chamber 1206 and the shaft chamber 1208. The check valve 1212*e* is positioned between the shaft chamber 1208 and the hose 1210, and regulates the flow of air between the shaft chamber 1208 and the hose 1210. The check valve 1212*f* is positioned at the end of the shaft chamber 1208, and regulates the flow of back from outside the pump 142' into the shaft chamber 1208 and hose 1210.

As shown in FIG. 12A, when the pump 142' is in a deflated state, the check valves 1212*a-e* are each closed, and the check valve 1212*f* is open. Thus, the pump chamber 1206 is sealed by the check valves 1212*a-d*, and the shaft chamber 1208 is sealed by the shaft chamber seal 1204 and the check valves 1212*a-e*.

Figure 12B:
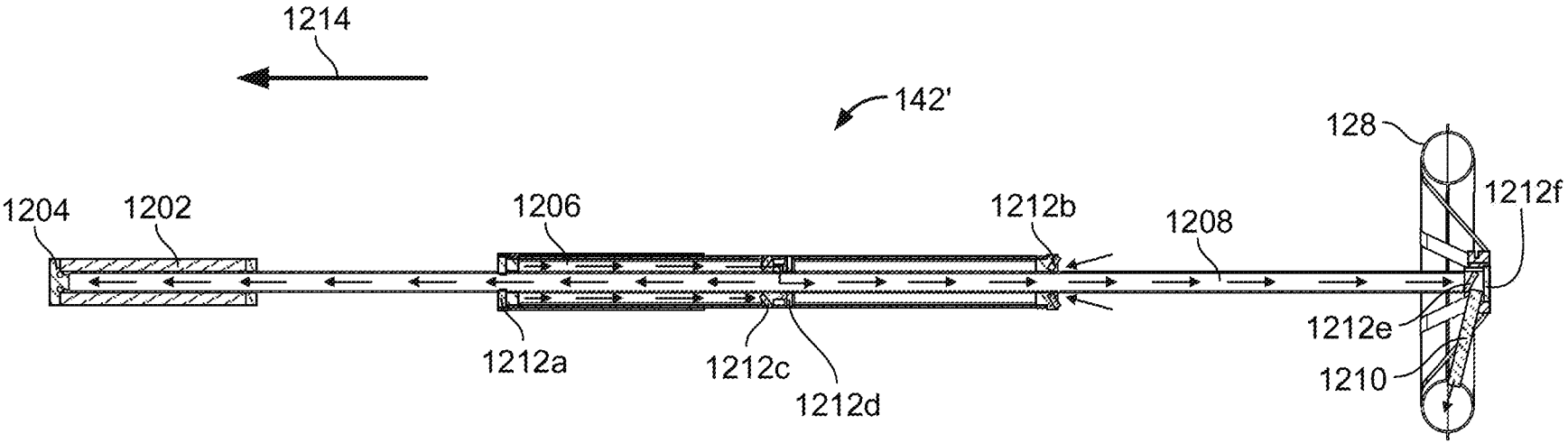

As shown in FIG. 12B, the user operates the pump 142' by drawing the handle 1202 in the direction of arrow 1214. In response, the check valves 1212*b*, 1212*c*, and 1212*e* open, while the check valves 1212*a*, 1212*d*, and 1212*f* close (or remain closed). As a result, air within the pump chamber 1206 between the check valves 1212*a* and 1212*c* is forced through the check valve 1212*c*, into the shaft chamber 1208, and into the hose 1210. As a result, air is compressed within the air bladder 128. Further, air from outside the pump 142' is drawn into the pump chamber 1206 through the check valve 1212*b*. As the check valve 1212*d* is closed, this air cannot flow into the shaft chamber 1208.

Figure 12C:
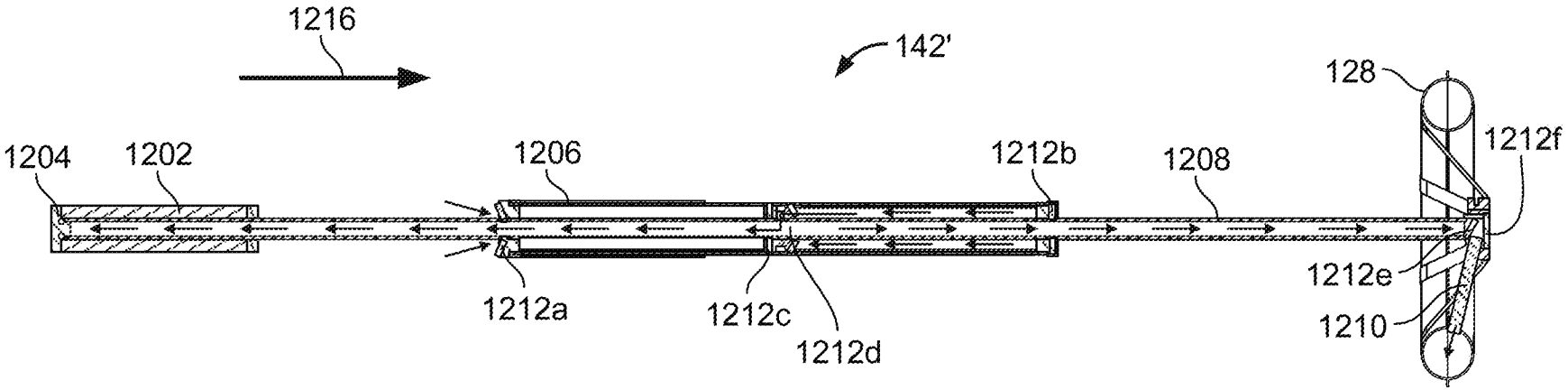

As shown in FIG. 12C, the user continues to operate the pump 142' by subsequently pushing the 1202 in the direction of arrow 1216. In response, the check valves 1212*a*, 1212*d*, and 1212*e* open, while the check valves 1212*b*, 1212*c*, and 1212*f* close (or remain closed). As a result, air within the pump chamber 1206 between the check valves 1212*b* and 1212*d* are forced through the check valve 1212*d*, into the shaft chamber 1208, and into the hose 1210. As a result, air is compressed within the air bladder 128. Further, air is drawn from outside the pump 142' is drawn into the pump chamber 1206 through the check valve 1212*a*. As the check valve 1212*c* is closed, this air cannot flow into the shaft chamber 1208.

Figure 12D:
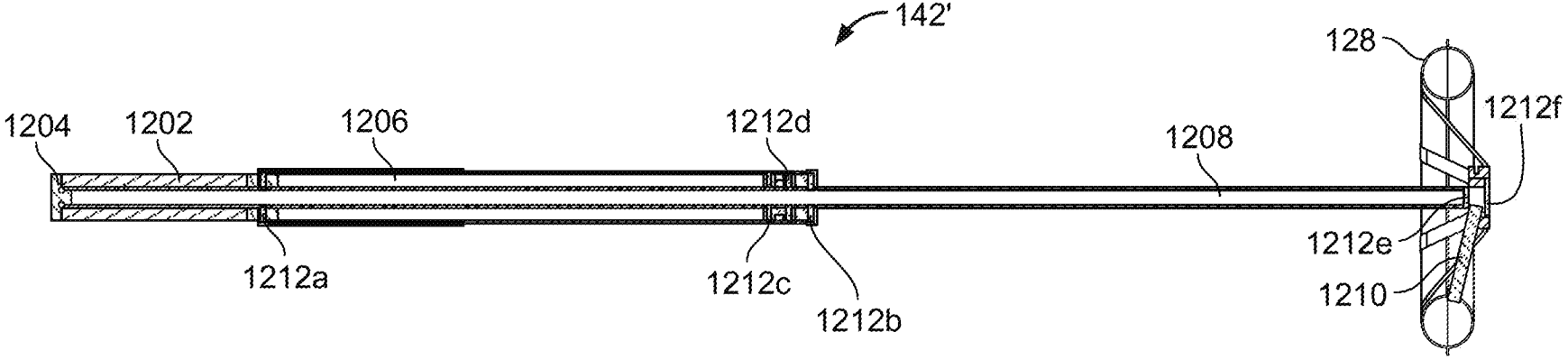

A user alternates between drawing the handle 1202 outward in the direction of the arrow 1214 and pressing the handle 1202 inward in the direction of the arrow 1216 to compress more and more air into the air bladder 128, thereby inflating the air bladder 128 and deploying the umbrella. As shown in FIG. 12D, when the pump 142' is in the fully deployed state, the check valves 1212*a-f* are each closed, thereby sealing the air contained within the pump 124' and the air bladder 128.

Figure 12E:
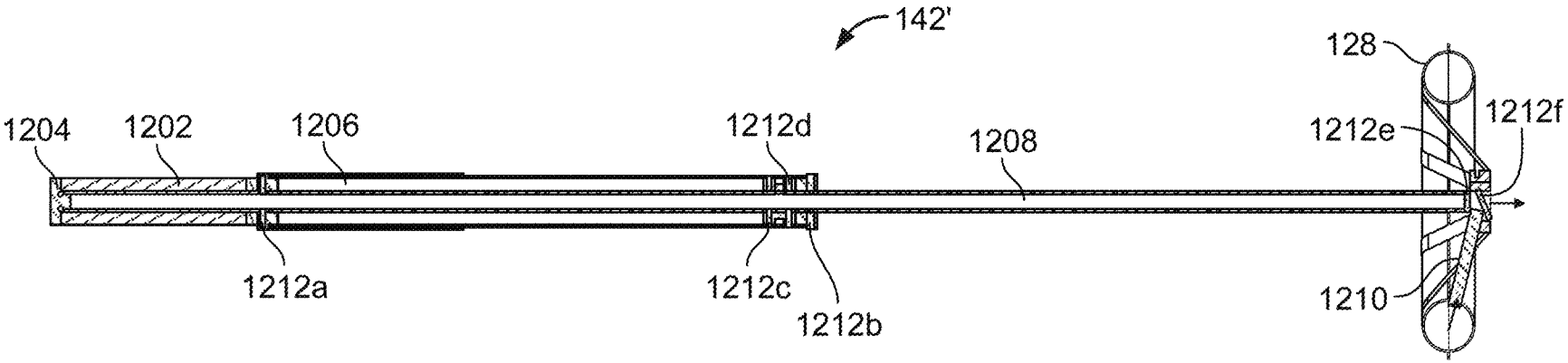

To stow the umbrella, a user can operate the pump 142', such that the check valve 1212*f* is opened. As shown in FIG. 12E, when the check valve 1212*f* is opened, compressed air from the air bladder 128 escapes through the hose 1210 to the outside of the pump 142'. As a result, the air bladder 128 deflates, thereby collapsing the umbrella into a stowed configuration. A user can operate the check valve 1212*f*, for example, using a button, lever, or switch configured to toggle the check valve 1212*f* between its open and closed positions.

Although an example arrangement of the handle 1202, the shaft chamber seal 1204, the pump chamber 1206, the shaft chamber 1208, the hose 1210, the check valves 1212*a-f* is shown, this is merely an illustrative example. In practice, the physical arrangement of components can vary, depending on the implementation. As an example, in some cases, one or more of the check valves 1212*a-f* are be positioned along different points of the pump 142' than that shown in FIGS. 12A-E.

Figure 13A:
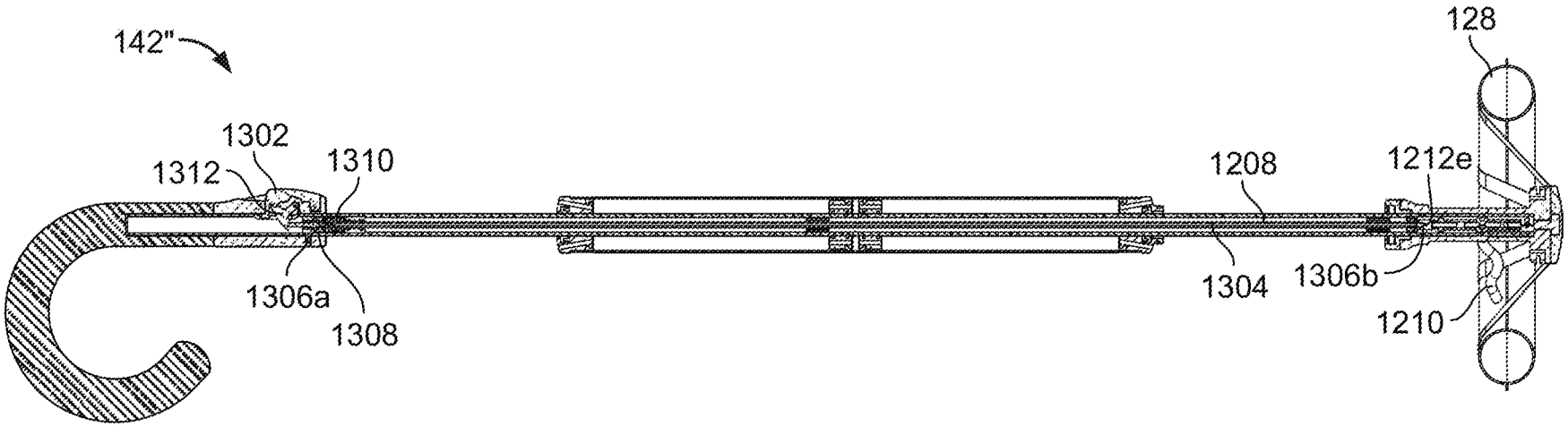
FIGS. 13A-D are cross-sectional views of an umbrella pump with an air release mechanism.
Figure 13C:
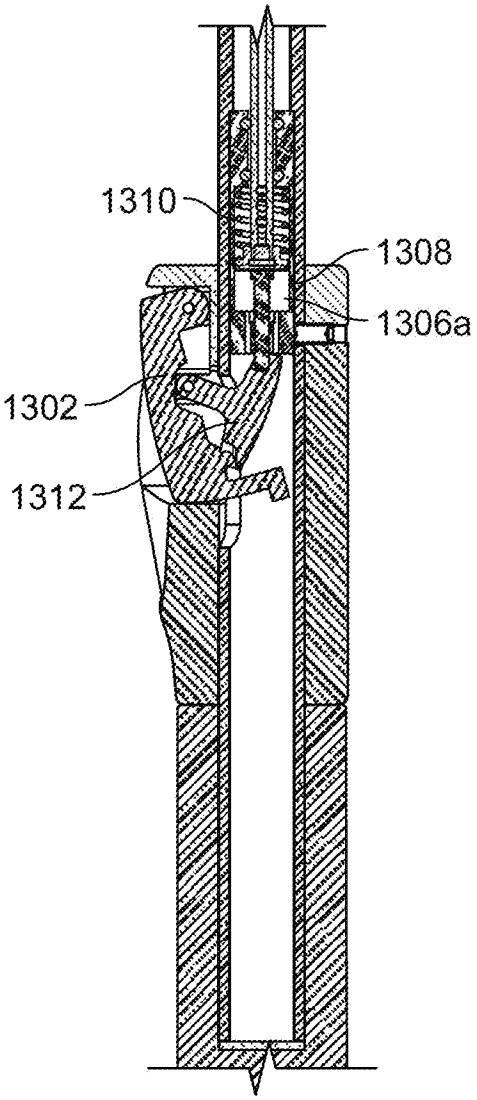
Figure 13B:
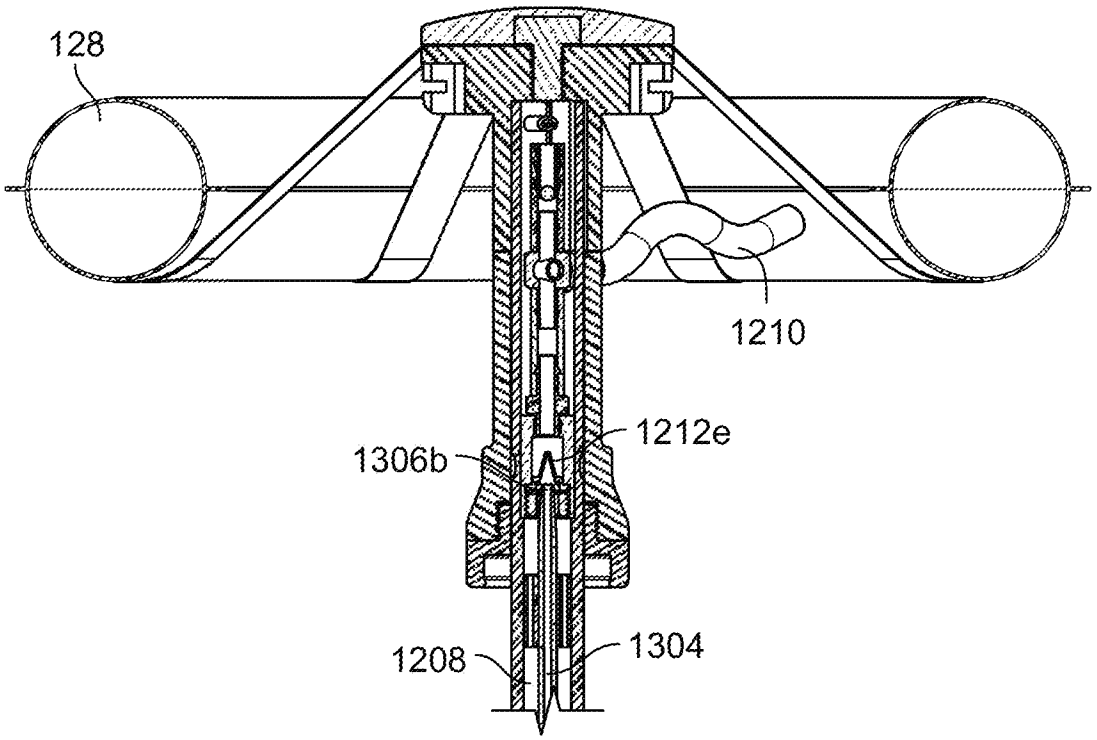
Figure 13D:
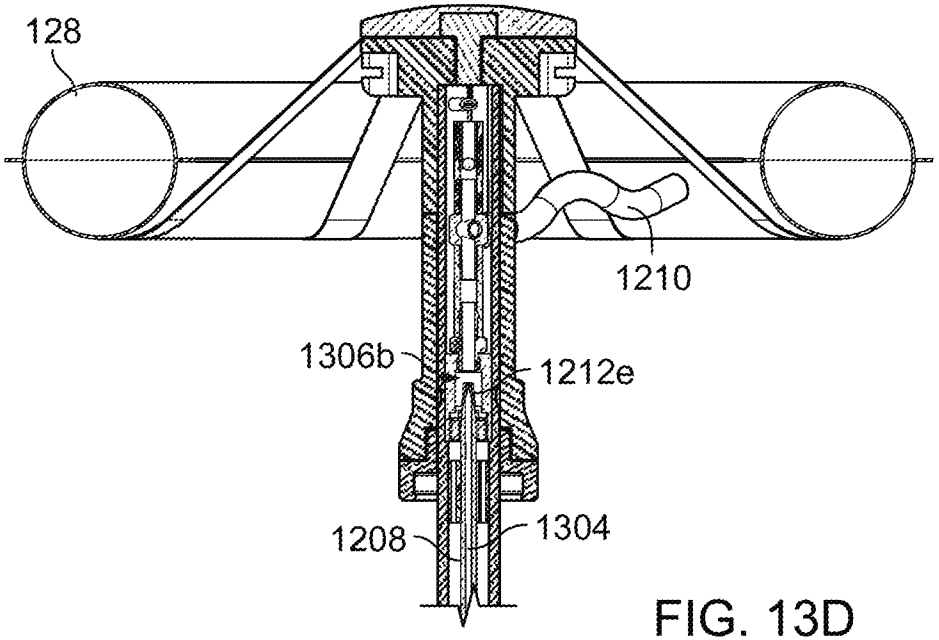

Further, although an example air release mechanism is described above, this this also merely an illustrative example. In practice, a pump can have various configurations that allow a user to selectively release air from the air bladder 128. As an illustrative example, FIG. 13A shows a pump 142" having a generally similar configuration as that shown in FIGS. 12A-E. In this case, however, the pump 142" includes a release button 1302 and an air escape tube 1304 within the shaft chamber 1208. The air escape tube 1304 is arranged such that one end 1306*a* of the air escape tube 1304 extends through a shaft chamber seal 1308 and is not sealed from the surrounding environment. The opposite end 1306*b* of the air escape tube 1304 is positioned just before the check valve 1212*e*, which regulates both the airflow between the shaft chamber 1208 and the hose 1210, and the airflow between the air escape tube 1304 from the shaft chamber 1208. The air escape tube 1304 is biased in this configuration by a spring 1310. In this configuration, the air escape tube 1304 is sealed, and the air from within the other components of the pump 142" and the air bladder 128 cannot flow into the air escape tube 1304. The end 1306*b* of the air escape tube 1304 and the check valve 1212*e* are shown in greater detail in FIG. 13B. However, as shown in FIG. 13C, when the release button 1302 is depressed, the air escape tube 1304 is pushed upwards by the lever 1312 against the spring 1310. As shown in FIG. 13D, as a result, the end 1306*b* of the air escape tube 1304 is pushed beyond the check valve 1212*e*, thereby allowing compressed air from the air bladder 128 to into the air escape tube 1304. This air flows then through the air escape tube 1304, out from the opposite end of the air escape tube 1304, and into the outside environment (e.g., through channels or gaps on or around the release button 1302). As a result, the air bladder 128 deflates, thereby collapsing the umbrella into a stowed configuration.

When the release button 1302 is released, the end 1306*b* of the air escape tube 1304 retracts through the check valve 1212*b*, thereby re-sealing the air escape tube 1304 from air bladder 128. The user can again operate the pump to inflate the air bladder (e.g., by cycling the pump, as described above).

Figure 14A:
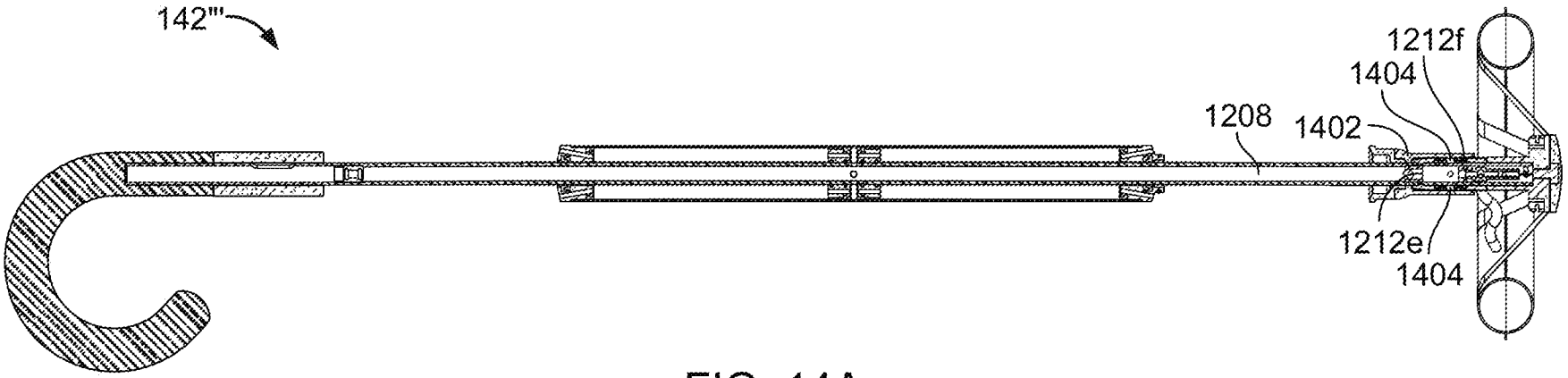
FIGS. 14A-C are cross-sectional views of an umbrella pump with another air release mechanism.
Figure 14B:
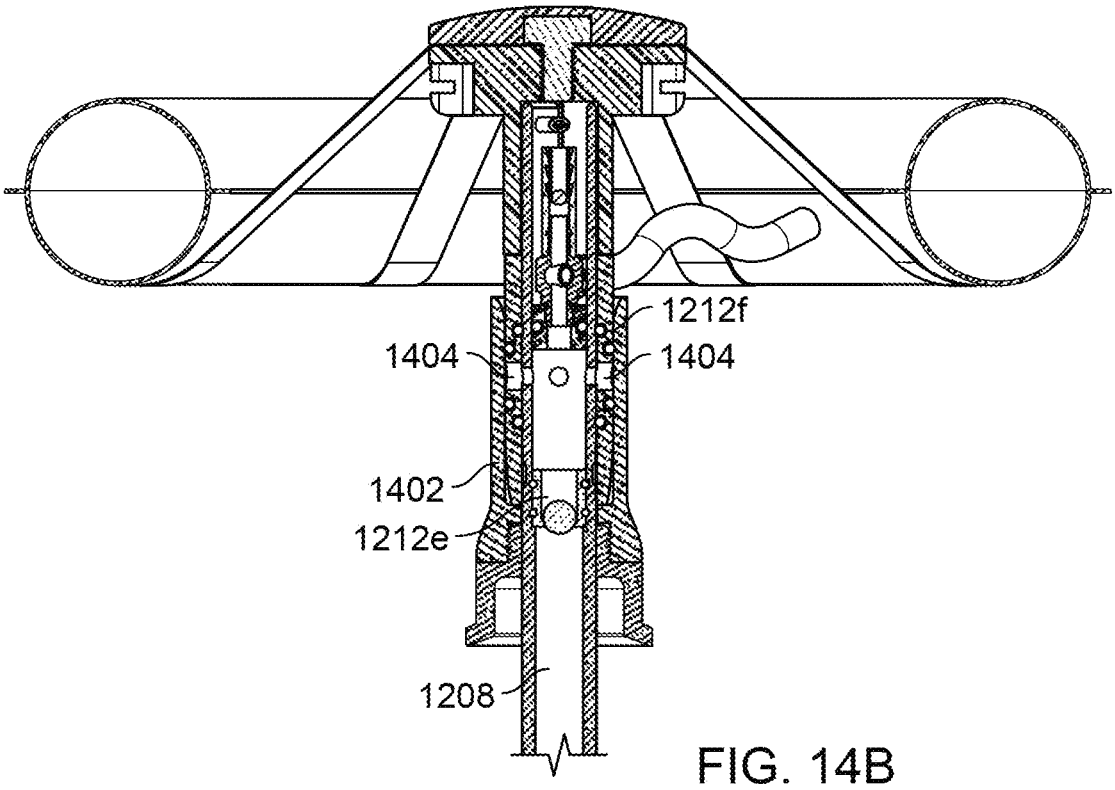

As another example, FIG. 14A shows a pump 142'" again having a generally similar configuration as that shown in FIGS. 12A-E. In this case, however, the pump 142'" includes an air release collar 1402 positioned about the shaft chamber 1208, and covering the portion of the shaft chamber 1208 between the check valves 1212*e* and 1212*f* The shaft chamber 1208 also includes several channels 1404 between the check valves 1212*e* and 1212*f* that allow air to flow out of the shaft chamber 1208 and/or air bladder 128. In this configuration, however, the channels 1404 are obstructed by the air release collar 1402. Thus, air from within the air bladder 128 cannot escape through the channels 1404 and into the surrounding environment. The air release collar 1402 and channels 1404 are shown in greater detail in FIG. 14B.

Figure 14C:
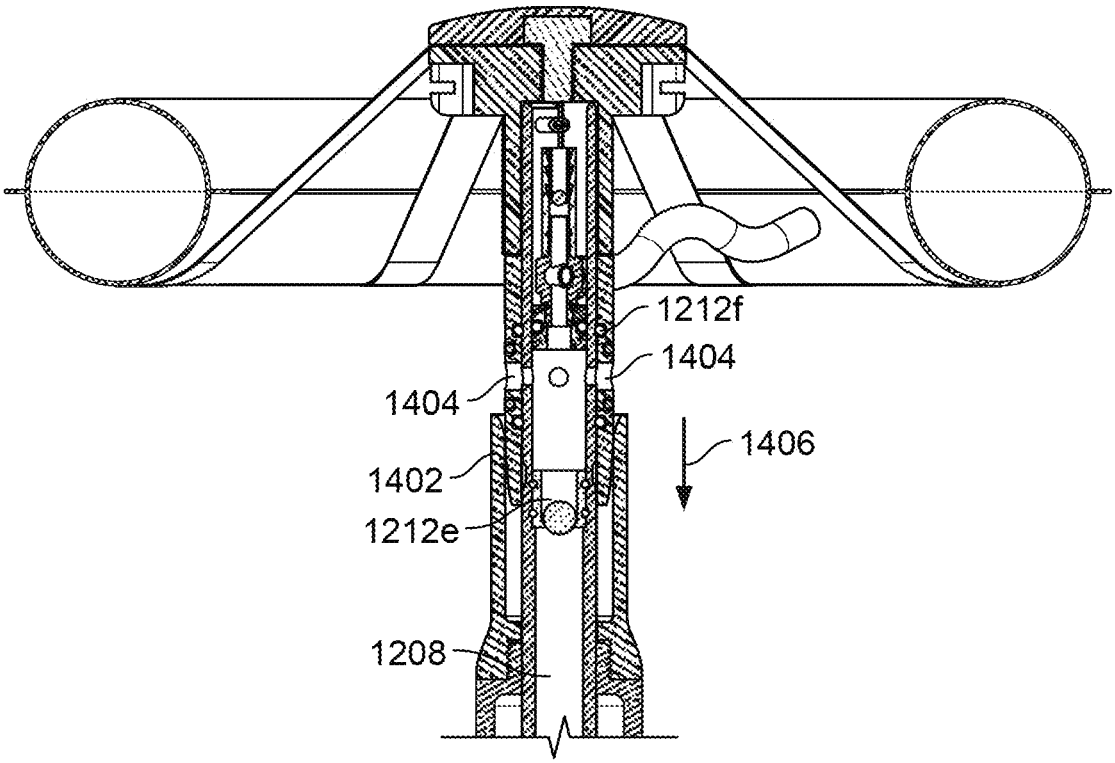

As shown in FIG. 14C, when the air release collar 1402 is pulled away from the channels 1404 (e.g., in the direction of arrow 1406), the channels 1404 are no longer obstructed by the air release collar 1402. As a result, compressed air from within the air bladder 128 escapes through the channels 1402. Consequently, the air bladder 128 deflates, thereby collapsing the umbrella into a stowed configuration.

When the release button 1302 is released, the air release collar 1402 retracts to its original position, and re-obstructs the channels 1404, thereby re-sealing the air bladder 128 from the outside environment. The user can again operate the pump to inflate the air bladder 128 (e.g., by cycling the pump, as described above).

In the umbrellas described above, the air bladders 128 are inflated using a manually-actuated pump 142. However, in some umbrellas, the air bladders 128 are inflated using other mechanisms, either in addition to or instead of a pump 142. For example, some umbrellas 100 include one or more containers of compressed air (e.g., a bottle of compressed air or $CO_2$) coupled to the air bladders 128. In an example usage, a user uses the containers to inject air into the air bladders 128 to deploy the canopy (e.g., by releasing air from the container using a release valve). In some cases, umbrellas include one or more electric pumps that allow a user to controllably inflate the air bladders 128, without requiring that the user manually cycle the pump. In some cases, the umbrella 100 includes a gas generator device that generates gas to deploy the canopy assembly. For example, some umbrellas includes a gas generator that generates nitrogen gas using a solid propellant, such as sodium azide.

A number of implementations have been described. Nevertheless, it will be understood that various modifications may be made without departing from the spirit and scope of the disclosure. Accordingly, other implementations are within the scope of the following claims.

What is claimed is:

1. An umbrella comprising:

a support assembly comprising:

a pump; and a handle; and a canopy assembly comprising:

a hub member attached to the handle;

a plurality of air bladders attached to the hub member and coupled to the air pump; and a sheet attached to each of the air bladders;

wherein the hub member comprises a plurality of valves, each valve associated with a corresponding air bladder and operable to control the release of air from the corresponding air bladder.

2. The umbrella of claim 1, wherein the umbrella is configured to reversibly switch between a stowed configuration and a deployed configuration.

3. The umbrella of claim 2, wherein in the stowed configuration, the air bladders are deflated.

4. The umbrella of claim 2, wherein in the deployed configuration, the air bladders are inflated and extend from the hub member at an angle with respect to the handle, and the sheet extends between adjacent air bladders.

5. The umbrella of claim 1, wherein the pump is incorporated into the handle.

* * * * *